US012480245B2

(12) United States Patent
Kim et al.

(10) Patent No.: US 12,480,245 B2
(45) Date of Patent: Nov. 25, 2025

(54) DETERGENT SUPPLY APPARATUS AND WASHING MACHINE HAVING SAME

(71) Applicant: SAMSUNG ELECTRONICS CO., LTD., Suwon-si (KR)

(72) Inventors: Byeongwoo Kim, Suwon-si (KR); Jindoo Kim, Suwon-si (KR); Hoon Wee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 219 days.

(21) Appl. No.: 18/125,340

(22) Filed: Mar. 23, 2023

(65) Prior Publication Data

US 2023/0228026 A1 Jul. 20, 2023

Related U.S. Application Data

(63) Continuation of application No. PCT/KR2021/015675, filed on Nov. 2, 2021.

(30) Foreign Application Priority Data

Nov. 23, 2020 (KR) ..... 10-2020-0157553

(51) Int. Cl.
*D06F 39/02* (2006.01)
*D06F 39/08* (2006.01)
(Continued)

(52) U.S. Cl.
CPC ..... *D06F 39/022* (2013.01); *D06F 39/085* (2013.01); *D06F 39/086* (2013.01);
(Continued)

(58) Field of Classification Search
CPC .... D06F 39/022; D06F 39/085; D06F 39/086; D06F 39/088; D06F 39/12;
(Continued)

(56) References Cited

U.S. PATENT DOCUMENTS 9,702,078 B2 7/2017 Lee
9,879,370 B2 1/2018 Jung et al.
(Continued)

FOREIGN PATENT DOCUMENTS

CN 110565336 A 12/2019
CN 108729133 B 10/2020
(Continued)

OTHER PUBLICATIONS

International Search Report dated Feb. 24, 2022, in International Application No. PCT/KR2021/015675.
(Continued)

*Primary Examiner* — Michael E Barr
*Assistant Examiner* — Thomas Bucci
(74) *Attorney, Agent, or Firm* — STAAS & HALSEY LLP

(57) ABSTRACT

A washing machine includes a cabinet; a tub in the cabinet; and a detergent supply apparatus which supplies detergent to the tub and includes: a housing; a detergent box configured to be inserted into the housing and thereby docked to the detergent pump so that detergent in the detergent box is suctionable by the detergent pump and then dischargeable by the detergent pump into the housing and configured to be withdrawn from the housing and thereby undocked from the detergent pump; and an auxiliary tank which in the housing, configured to store water, and to, when the detergent box is being withdrawn from the housing, drain water stored in the auxiliary tank to a bottom of the housing so that detergent from the discharge pump falls into the water on the bottom of the housing.

16 Claims, 21 Drawing Sheets

(51) Int. Cl.
*D06F 39/12* (2006.01)
*D06F 103/42* (2020.01)
*D06F 105/42* (2020.01)

(52) U.S. Cl.
CPC ..... *D06F 39/088* (2013.01); *D06F 39/12* (2013.01); *D06F 2103/42* (2020.02); *D06F 2105/42* (2020.02)

(58) Field of Classification Search
CPC ..... D06F 2103/42; D06F 2105/42; D06F 39/024; D06F 39/081
USPC ..... 68/17 R
See application file for complete search history.

(56) References Cited

U.S. PATENT DOCUMENTS

| | | | | |
|---|---|---|---|---|
| 11,193,234 | B2 | 12/2021 | Lee et al. | |
| 11,214,912 | B2 | 1/2022 | Jung et al. | |
| 11,434,597 | B2 | 9/2022 | Lv et al. | |
| 11,459,690 | B2 | 10/2022 | Jung et al. | |
| 2010/0000581 | A1 | 1/2010 | Doyle et al. | |
| 2012/0096903 | A1* | 4/2012 | Kim | D06F 39/02 68/17 R |
| 2012/0291916 | A1* | 11/2012 | Hwang | C02F 1/686 141/311 R |
| 2013/0312463 | A1* | 11/2013 | Kim | D06F 39/022 222/173 |
| 2014/0109620 | A1 | 4/2014 | Yoon | |
| 2014/0144191 | A1* | 5/2014 | Back | G01R 27/00 222/173 |
| 2015/0114047 | A1* | 4/2015 | Jung | D06F 39/022 68/17 R |
| 2016/0177491 | A1* | 6/2016 | Da Pont | D06F 39/02 222/135 |
| 2016/0258106 | A1* | 9/2016 | Kim | D06F 39/022 |
| 2020/0048814 | A1* | 2/2020 | Jung | D06F 39/085 |
| 2020/0232134 | A1* | 7/2020 | Jung | D06F 39/028 |

FOREIGN PATENT DOCUMENTS

| | | | | |
|---|---|---|---|---|
| EP | 1 449 952 | B1 | 12/2010 | |
| JP | 2002-355494 | | 12/2002 | |
| KR | 1993-0013338 | | 7/1993 | |
| KR | 95-23783 | | 8/1995 | |
| KR | 0134735 | | 3/1996 | |
| KR | 10-0421883 | | 3/2004 | |
| KR | 10-2005-0118615 | | 12/2005 | |
| KR | 10-2007-0088212 | | 8/2007 | |
| KR | 10-2007-0117914 | | 12/2007 | |
| KR | 10-0987447 | | 10/2010 | |
| KR | 10-2013-0048451 | | 5/2013 | |
| KR | 20130048451 | A * | 5/2013 | D06F 33/34 |
| KR | 10-1330244 | | 11/2013 | |
| KR | 10-1343712 | | 12/2013 | |
| KR | 10-2016-0058737 | | 5/2016 | |
| KR | 10-2019-0009729 | | 1/2019 | |
| KR | 10-2020-0017953 | | 2/2020 | |
| KR | 10-2020-0120199 | | 10/2020 | |
| WO | WO 2015/074688 | A1 | 5/2015 | |

OTHER PUBLICATIONS

Written Opinion dated Feb. 24, 2022, in International Application No. PCT/KR2021/015675.
Office Action dated Nov. 17, 2023, in European Application No. EP 21 89 4952.
Office Action dated Feb. 14, 2025 issued in European Application No. 21 894 952.7.
Office Action dated Aug. 26, 2025, in Korean Patent Application No. 10-2020-0157553.

* cited by examiner

DETERGENT SUPPLY APPARATUS AND WASHING MACHINE HAVING SAME

CROSS-REFERENCE TO RELATED APPLICATION(S)

This application is a continuation of International Application No. PCT/KR2021/015675, filed on Nov. 2, 2021, and claims priority to Korean Patent Application No. 10-2020-0157553, filed on Nov. 23, 2020, in the Korean Intellectual Property Office, the disclosures of which are incorporated by reference herein in their entireties.

BACKGROUND

1. Field

The disclosure relates to a washing machine improved to prevent hardening of detergent that has fallen to the bottom of a housing when a detergent box is separated from a detergent supply apparatus.

2. Description of Related Art

In general, a washing machine is a device that washes laundry using a driving force of a motor to agitate laundry, wash water, and detergent introduced into a washing tub together so that washing is performed by mutual friction.

A detergent supply apparatus is an apparatus that allows a detergent to be evenly mixed and supplied together with water being supplied in a process of supplying water to the inside of a tub of the washing machine. When the detergent is a liquid detergent, the liquid detergent may be directly supplied into the tub.

The detergent supply apparatus is provided to be embedded in a front portion of an upper part of a main body of the washing machine, and includes a box-shaped housing having a front that is openable, and a detergent box mounted to enter the housing through the open front of the housing and detachable in the form of a drawer.

Recently, there is a use of a washing machine equipped with a liquid detergent supply apparatus in which a detergent box has a detergent input space formed inside for a liquid detergent such that a liquid detergent, such as a rinsing agent and a bleach, is used.

A detergent pump may be fixed to the housing to perform pumping to suction a detergent in the detergent box and discharge the detergent to the housing. Upon the detergent box entering the housing and being docked onto the detergent pump, the detergent in the detergent box may be suctioned into the detergent pump by the detergent pump and then discharged into the housing. The detergent discharged into the housing may be supplied into the tub together with water being supplied.

The detergent pump is provided with a detergent detecting unit for detecting the amount of a residual detergent. The detergent detecting unit is provided to, upon insufficiency of the detergent in the detergent box, display the result on a display unit of the washing machine. When the display unit of the washing machine indicates that the detergent is insufficient, the user undocks the detergent box from the detergent pump to replenish the detergent box. When the detergent box is undocked from the detergent pump, a detergent remaining in the detergent pump may fall to the bottom of the housing and may harden. When the detergent hardens on the bottom of the housing, the user may have an inconvenience of cleaning the detergent.

The detergent detecting unit is installed in a suction portion, which suctions a detergent of the detergent box upon the detergent box being docked onto the detergent pump, to detect the amount of a remaining detergent. The detergent detecting unit is provided in a form of a pair of sensors installed in the suction portion, and since all of the pair of sensors need to be installed in the suction portion, the suction portion may need to have a large diameter. In proportion to the increasing diameter of the suction portion, the amount of the detergent remaining in the suction portion may increase when the detergent box is undocked from the detergent pump, in which case the amount of the detergent falling to the bottom of the housing may also increase.

SUMMARY

A washing machine according to an aspect of the disclosure includes: a cabinet; a tub inside the cabinet; and a detergent supply apparatus configured to supply detergent to the tub, the detergent supply apparatus including: a housing; a detergent pump fixed to the housing; a detergent box configured to be inserted into the housing and thereby be docked to the detergent pump so that detergent in the detergent box is suctionable by the detergent pump and then dischargeable by the detergent pump into the housing, and configured to be withdrawn from the housing and thereby be undocked from the detergent pump; and an auxiliary tank, in the housing to store water and to, when the detergent box is being withdrawn from the housing, drain water stored in the auxiliary tank to a bottom of the housing so that detergent falling from the detergent pump falls into the water on the bottom of the housing.

The housing has an opening in a front portion of the housing through which the detergent box is insertable to be inserted into the housing and through which the detergent box is withdrawable to be withdrawn from the housing, and the auxiliary tank is on a rear wall inside the housing.

The auxiliary tank may include a water storage portion in which the stored water may be stored, a drain port that includes a drain hole through which the water stored in the water storage portion may be drained, and a circular distribution groove around the drain hole that distributes the water drained from the drain hole to the bottom of the housing.

The washing machine may further include a housing cover covering an upper side of the housing and, including a plurality of water supply holes through which water is suppliable to the housing so that water supplied through some of the plurality of water supply holes falls into and is stored in the water storage portion.

The detergent pump may include: a fixing portion including a suction portion and a discharge portion; and a pumping portion configured to perform pumping so that detergent in the detergent box may be suctioned into the suction portion and then discharged by the discharge portion into the housing.

The auxiliary tank may include a water storage portion in which the stored water may be stored, and a drain port that includes a drain hole through which the water stored in the water storage portion may be drained, and a distribution rib at a lower side of the drain hole that distributes the water drained from the drain hole to the bottom of the housing.

The detergent box may include a detergent discharge portion configured to be docked to the suction portion to dock the detergent box to the detergent pump, and to be undocked from the suction portion to undock the detergent box from the detergent pump, and an opening and closing member configured to, upon the detergent discharge portion being docked to the suction portion, close the drain hole, and upon the detergent discharge portion being undocked from the suction portion, open the drain hole.

The detergent discharge portion and the opening and closing member each protrude rearward from a rear surface of the detergent box with the detergent discharge portion protruding further from the rear surface of the detergent box than the opening and closing member.

The detergent box is configured so that when the detergent box is being undocked from the suction portion, the opening and closing member may open the drain hole before the detergent discharge portion is completely undocked from the suction portion.

The detergent box may be configured so that before the detergent discharge portion is completely undocked from the suction portion, the water stored in the water storage portion may be drained to the bottom of the housing through the drain hole.

The housing may include: an opening portion that may be open to allow a part of the fixing portion to pass therethrough; an extending portion extending from the opening portion, into which a remaining part of the fixing portion may be insertable to be fixed to the extending portion; and a water supply portion allowing detergent discharged from the discharge portion into the housing and through the opening portion to be supplied to the tub together with water.

The detergent box may include a first detergent box configured to hold a main detergent, and a second detergent box configured to hold a preliminary detergent, the detergent pump being configured to individually suction and discharge to the housing the main detergent and the preliminary detergent individually.

The detergent pump may include a first detergent pump configured to suction the main detergent from the first detergent box and discharge the main detergent to the housing, and a second detergent pump configured to suction the preliminary detergent from the second detergent box and discharge the preliminary detergent to the housing.

The washing machine may include a detergent detecting unit to detect a detergent remaining in the detergent pump, the detergent detecting unit including a first detecting unit including a first sensor and a second sensor in the first detergent pump and a second detecting unit including a third sensor and a fourth sensor in the second detergent pump.

The first sensor and the second sensor have different heights from the bottom of the housing, and the third sensor, and the fourth sensor have different heights from the bottom of the housing.

DETAILED DESCRIPTION

Figure 1:
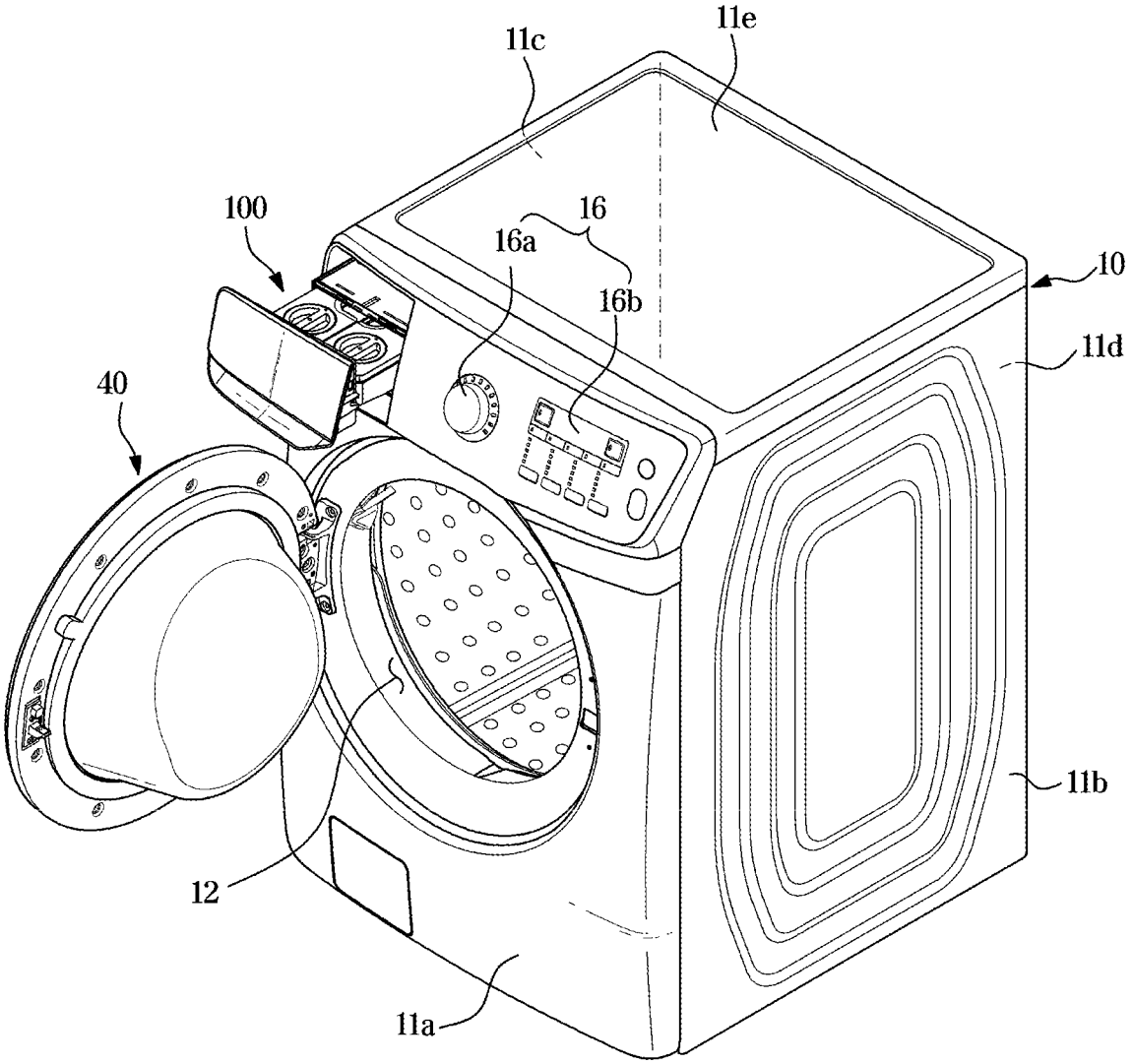
FIG. 1 is a perspective view illustrating a state in which a door of a washing machine is opened and a detergent box is withdrawn according to an embodiment of the disclosure.

Embodiments described in the specification and configurations shown in the accompanying drawings are merely exemplary examples of the present disclosure, and various modifications may replace the embodiments and the drawings of the present disclosure at the time of filing of the present application.

Further, identical symbols or numbers in the drawings of the present disclosure denote components or elements configured to perform substantially identical functions.

Further, terms used herein are only for the purpose of describing particular embodiments and are not intended to limit to the present disclosure. The singular form is intended to include the plural form as well, unless the context clearly indicates otherwise. It should be further understood that the terms "include," "including," "have," and/or "having" specify the presence of stated features, integers, steps, operations, elements, components, and/or groups thereof, but do not preclude the presence or addition of one or more other features, integers, steps, operations, elements, components, and/or groups thereof.

Further, it should be understood that, although the terms "first," "second," etc. may be used herein to describe various elements, the elements are not limited by the terms, and the terms are only used to distinguish one element from another. For example, a first element could be termed a second element, and similarly, a second element could be termed a first element without departing from the scope of the present disclosure. The term "and/or" includes combinations of one or all of a plurality of associated listed items.

Meanwhile, the terms "front", "rear", "upper", "lower", "front", "rear", "top" and "bottom" used in the following description are defined based on drawings, and the shape and position of each component are not limited by the terms. One aspect of the disclosure provides a detergent supply apparatus improved to prevent hardening of a detergent that falls to the bottom of a housing when a detergent box is undocked from a detergent pump to replenish detergent, and a washing machine having the same.

Another aspect of the disclosure provides a detergent supply apparatus having an improved installation position of a detergent detecting unit for detecting a remaining amount of detergent, and a washing machine having the same.

According to embodiments of the disclosure, a detergent remaining in a detergent pump can be prevented from directly falling to the bottom of a housing when a detergent box is separated.

In addition, a suction portion of a detergent pump is provided with a smaller diameter so that the amount of a detergent remaining in the suction portion can be reduced.

Hereinafter, embodiments according to the disclosure will be described in detail with reference to the accompanying drawings.

Figure 2:
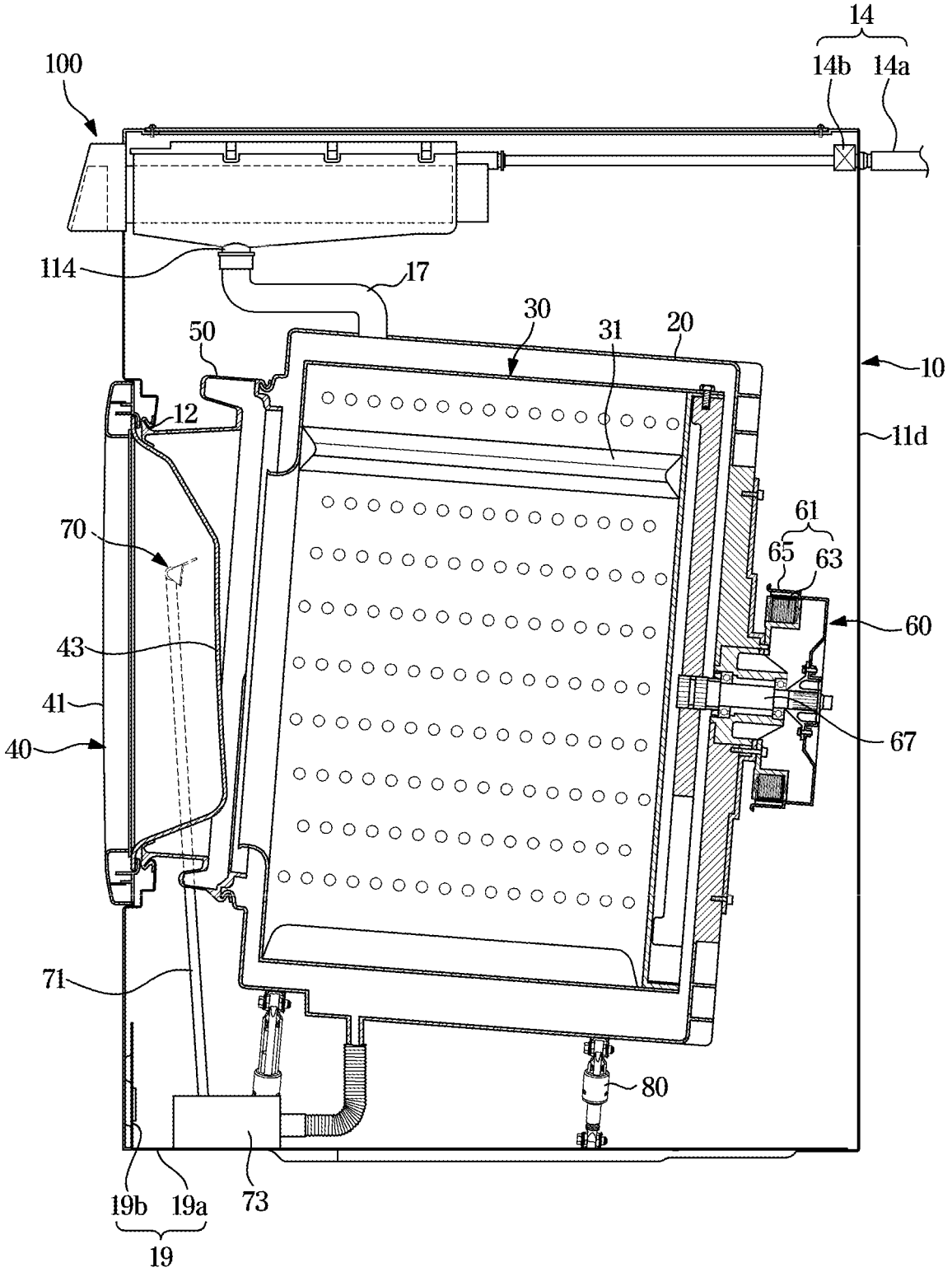
FIG. 2 is a cross-sectional view illustrating a washing machine according to an embodiment of the disclosure.

FIG. 1 is a perspective view illustrating a state in which a door of a washing machine is opened and a detergent box is withdrawn according to an embodiment of the disclosure. FIG. 2 is a cross-sectional view illustrating a washing machine according to an embodiment of the disclosure.

Hereinafter, a direction in which a detergent box 120 of a detergent supply apparatus 100 is withdrawn from a housing 110 is defined as a front, and based on which a rear side, left and right sides, and upper and lower sides may be defined.

As shown in FIGS. 1 and 2, a washing machine may include a cabinet 10 forming the external appearance and accommodating various components therein, a tub 20 provided inside the cabinet 10 to store mixed water in which water and detergent are mixed, a drum 30 provided inside the tub 20 and configured to rotate while accommodating laundry therein, a driving device 60 rotating the drum 30, and a detergent supplying detergent 100 providing a detergent to the tub 20.

The cabinet 10 may be formed in a substantially hexahedral shape. The cabinet 10 may be formed in a box shape having an open front. The cabinet 10 may include a front panel 11*a* provided on the open front, side plates 11*b* and 11*c* disposed on the opposite lateral sides rearward of the front panel 11*a*, and a rear plate 11*d* provided at a rear of the cabinet 10. In the embodiment of the disclosure, the rear plate 11*d* and the side plates 11*b* and 11*c* of the cabinet 10 are integrally formed with each other, but the aspect of the disclosure is not limited thereto. The cabinet 10 may include a base 19 provided on the bottom and a top cover 11*e* provided on the upper surface thereof.

The cabinet 10 may be provided on the front surface thereof with a control panel 16 including an input unit 16*a* for receiving operation commands from a user and a display unit 16*b* for displaying operation information of the washing machine.

The base 19 may include a lower frame 19*a* formed to cover a lower portion of the cabinet 10 and a lower reinforcing frame 19*b* formed to extend from the lower frame 19*a*.

The front panel 11*a* may be formed with an opening 12 through which laundry may be inserted into the drum 30. The tub 20 and the drum 30 may be provided with openings through which laundry may be inserted or withdrawn through the front of cabinet 10, and the openings of the tub 20 and the drum 30 may be provided at positions corresponding to the position of the opening 12 of the front panel 11*a*.

The opening 12 provided in the front panel 11*a* may be opened and closed by a door 40. The door 40 may be rotatably mounted on the front panel 11*a* of the cabinet 10 by a hinge member (not shown). The door 40 may include a door frame 41 and a door glass 43. The door glass 43 may be formed of a transparent tempered glass material to enable the inside of the cabinet 10 to be seen through.

A water supply device 14 including a water supply pipe 14*a* and a water supply valve 14*b* for controlling supply of water may be provided on an upper side of the tub 20. In addition, a detergent supply apparatus 100 for supplying a detergent to the inside of the tub 20 during a water supply process may be installed on a front upper side of the tub 20.

The detergent supply apparatus 100 may be connected to the tub 20 through a supply pipe 17. Water supplied through the water supply pipe 14*a*, while passing through the detergent supply apparatus 100, may be mixed with detergent, and the mixture of water and detergent may be supplied into the tub 20. When the detergent is a liquid detergent, water of the water supply pipe 14*a* may be directly supplied into the tub 20 through a separate control valve (not shown), and the liquid detergent may be supplied into the tub 20 through a detergent supply pipe (not shown) via the detergent supply apparatus 100, and then, finally. to the inside of the tub 20.

A driving unit 60 may be provided behind the drum 30. The driving unit 60 may be a component for rotating the drum 30 and may be provided to rotate the drum 30 by transmitting a driving force generated by a motor 61 to a rotary shaft 67.

The motor 61 may include a fixed stator 63 and a rotor 65 that rotates by electromagnetically interacting with the stator 63, to convert electrical power into mechanical rotational force.

The tub 20 may be provided to store mixed water in which water is mixed with detergent, and formed in a substantially cylindrical shape. The tub 20 may be fixed inside the cabinet 10. The opening 12 of the front panel 11*a* may be connected to the tub 20 by a diaphragm 50.

The diaphragm 50 may be provided at one side thereof with a spray nozzle 70 that is connected to a circulation hose 71 to inject circulating mixed water into the drum 30. The spray nozzle 70 may be provided to evenly spray the mixed water to the entire laundry accommodated in the drum 30. The circulation hose 71 may be connected to a circulation pump 73 for pumping the mixed water stored in a lower portion of the tub 20.

The drum 30 may rotate inside the tub 20 in which laundry is lifted and dropped so that washing is performed. A plurality of lifters 31 may be provided inside the drum 30.

A drain device (not shown) including a drain pipe (not shown) for draining water inside the tub 20, a drain valve (not shown), and the like may be installed below the tub 20.

The tub 20 may be provided to be elastically supported from the cabinet 10 by springs (not shown) provided on the upper side thereof and dampers 80 provided on the lower side thereof. That is, the springs and the dampers 80 absorb vibration energy between the tub 20 and the cabinet 10 when vibration generated during rotation of the drum 30 is transmitted to the tub 20 and the cabinet 10, thereby attenuating the vibration.

Figure 3:
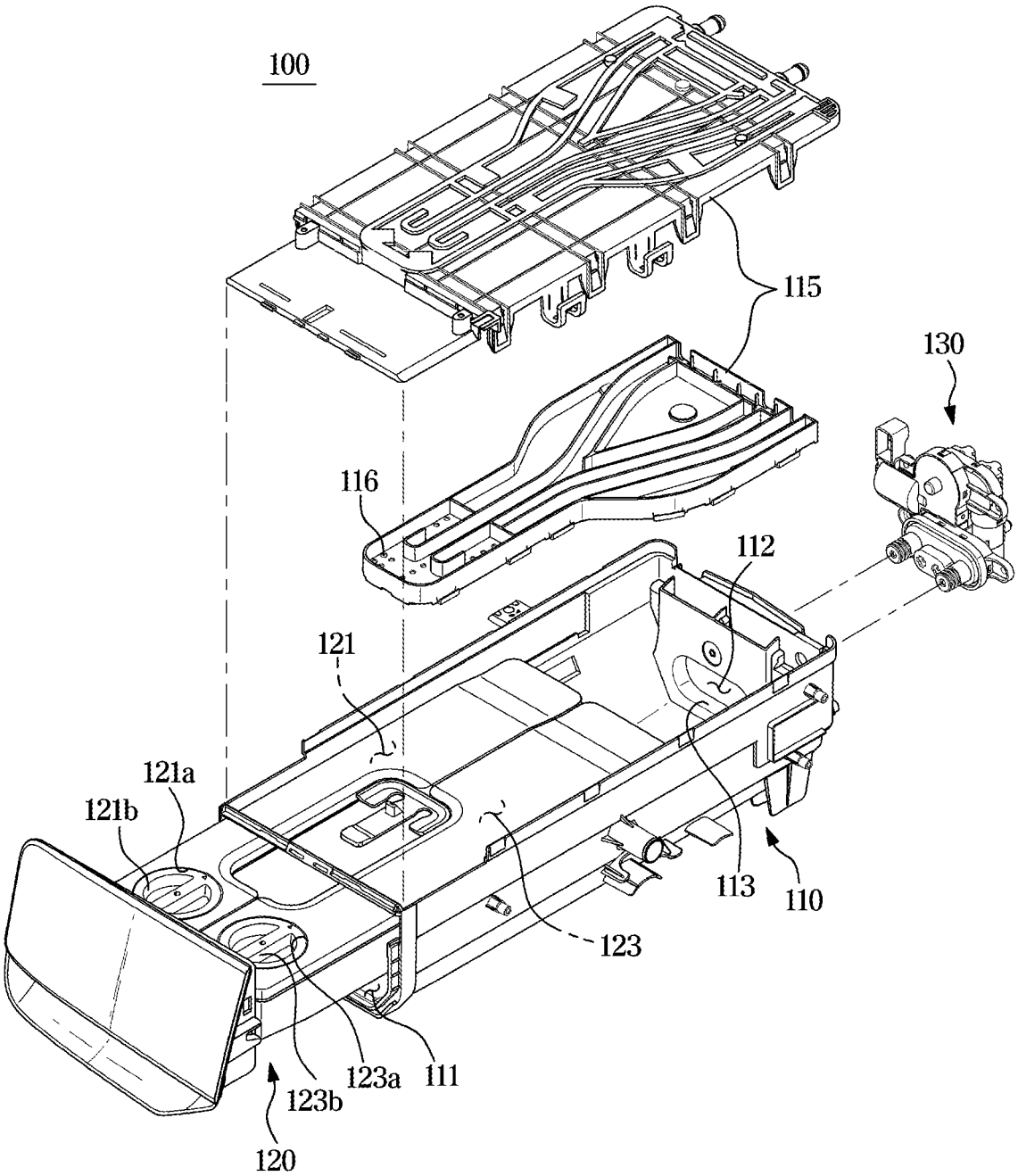
FIG. 3 is an exploded view illustrating a part of a detergent supply apparatus according to an embodiment of the disclosure.
Figure 4:
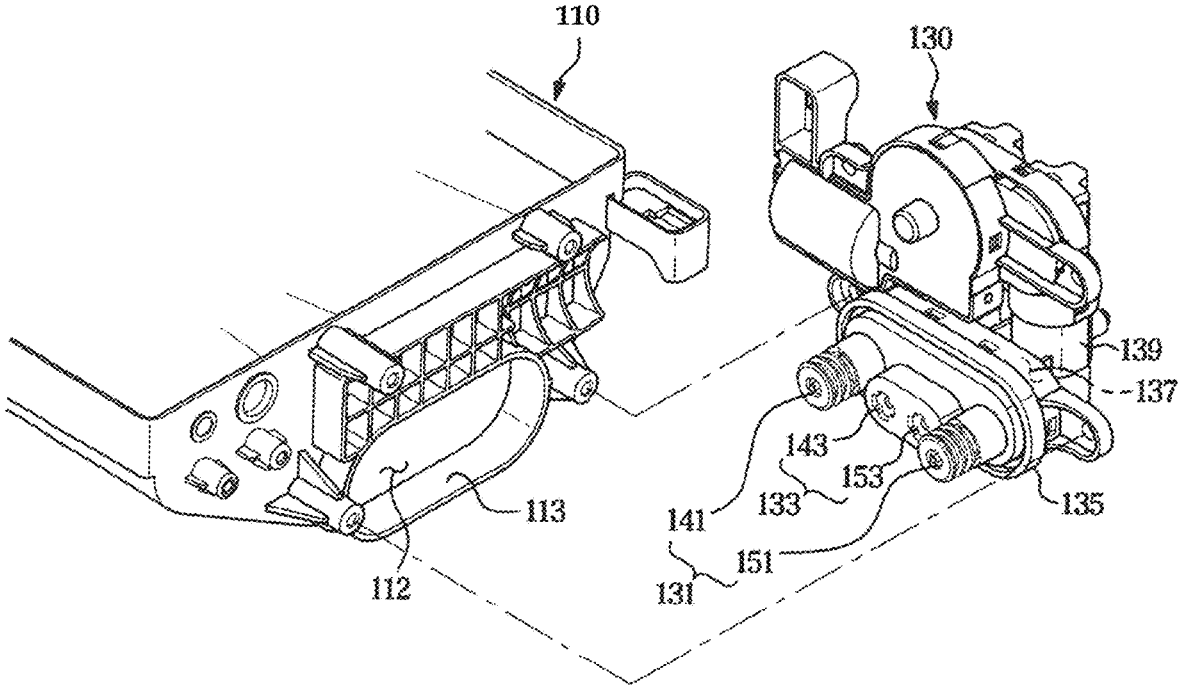
FIG. 4 is a view illustrating a process in which a detergent pump of a detergent supply apparatus is fixed to a housing according to an embodiment of the disclosure.
Figure 5:
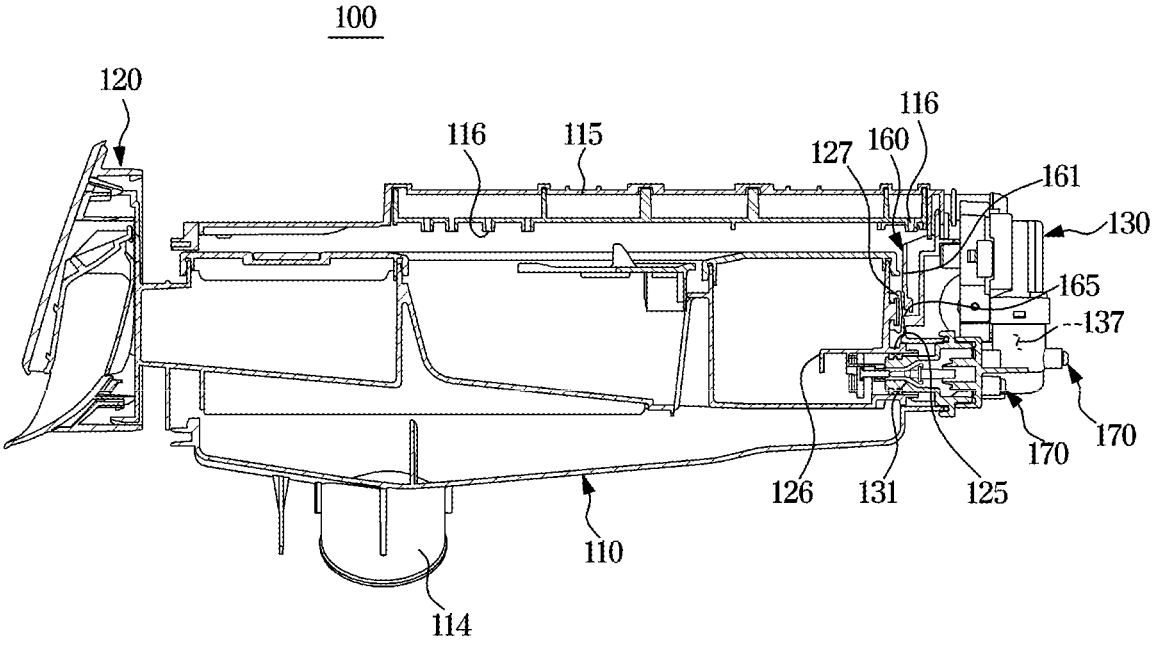
FIG. 5 is a side cross-sectional view illustrating a detergent supply apparatus according to an embodiment of the disclosure.
Figure 6:
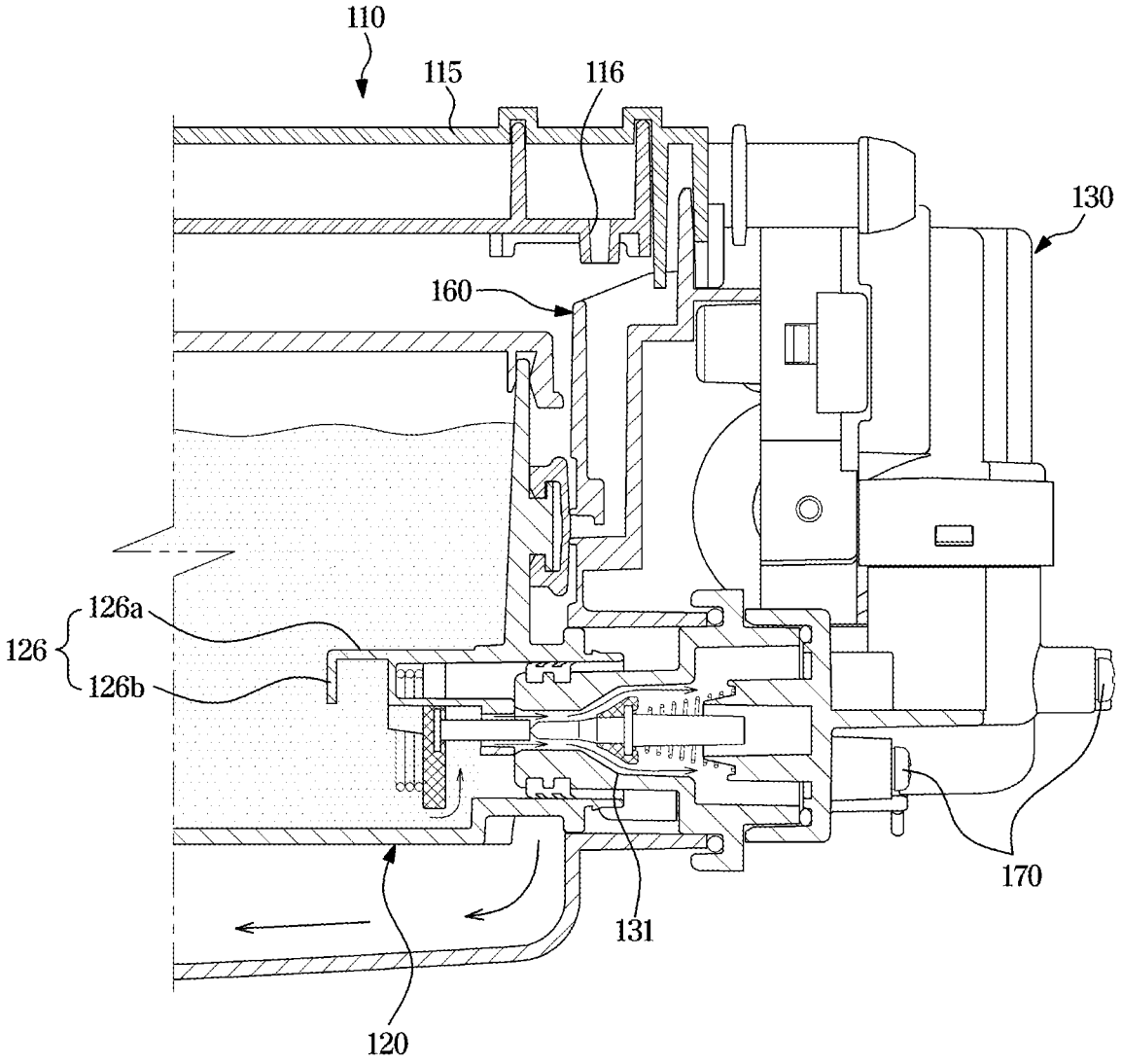
FIG. 6 is a view illustrating a state in which an entry of a detergent discharge portion is completely submerged in a detergent according to an embodiment of the disclosure.
Figure 7:
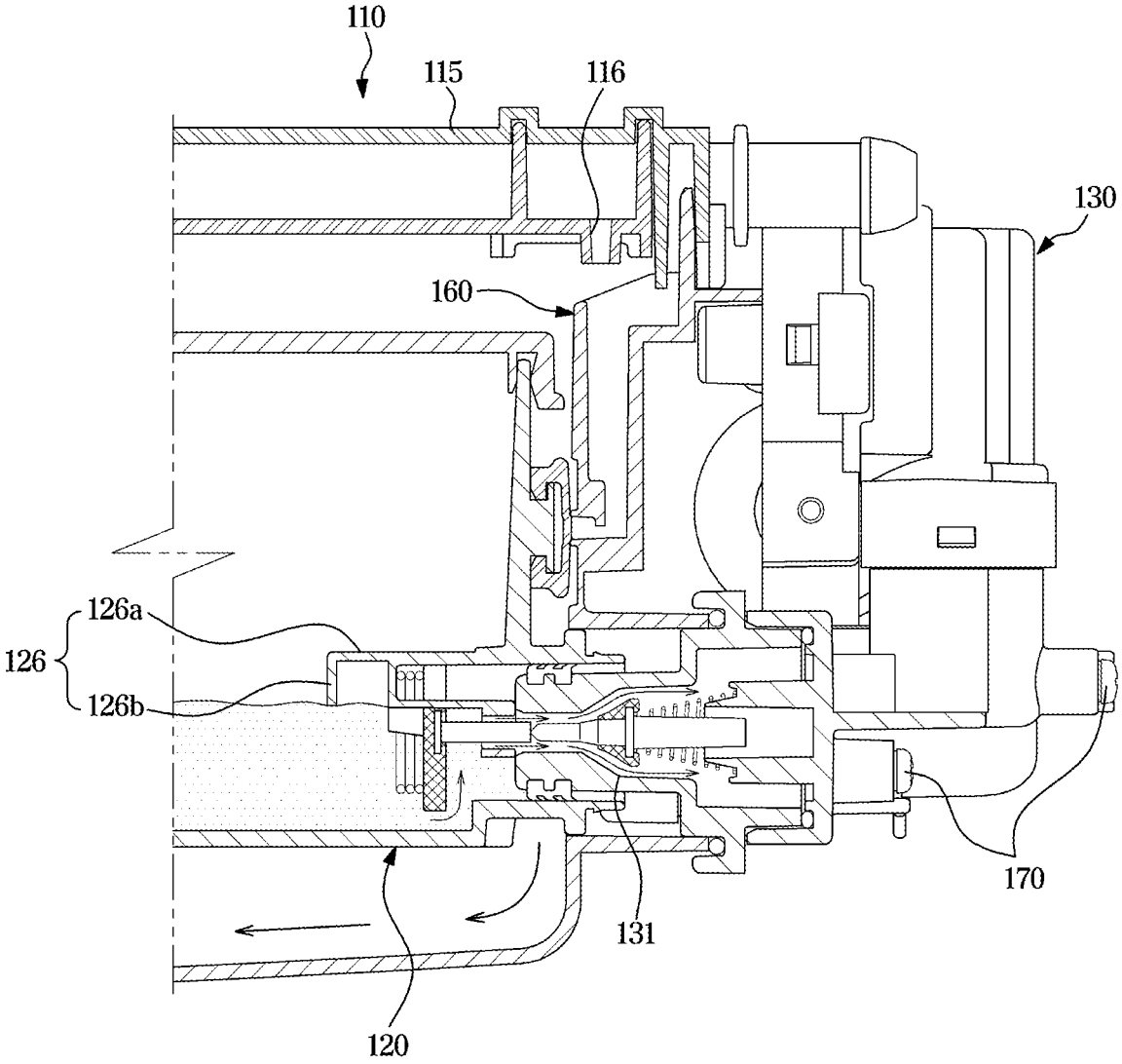
FIG. 7 is a view illustrating a state in which an end tip of a second bent portion among bent portions is immersed in a detergent according to an embodiment of the disclosure.
Figure 8:
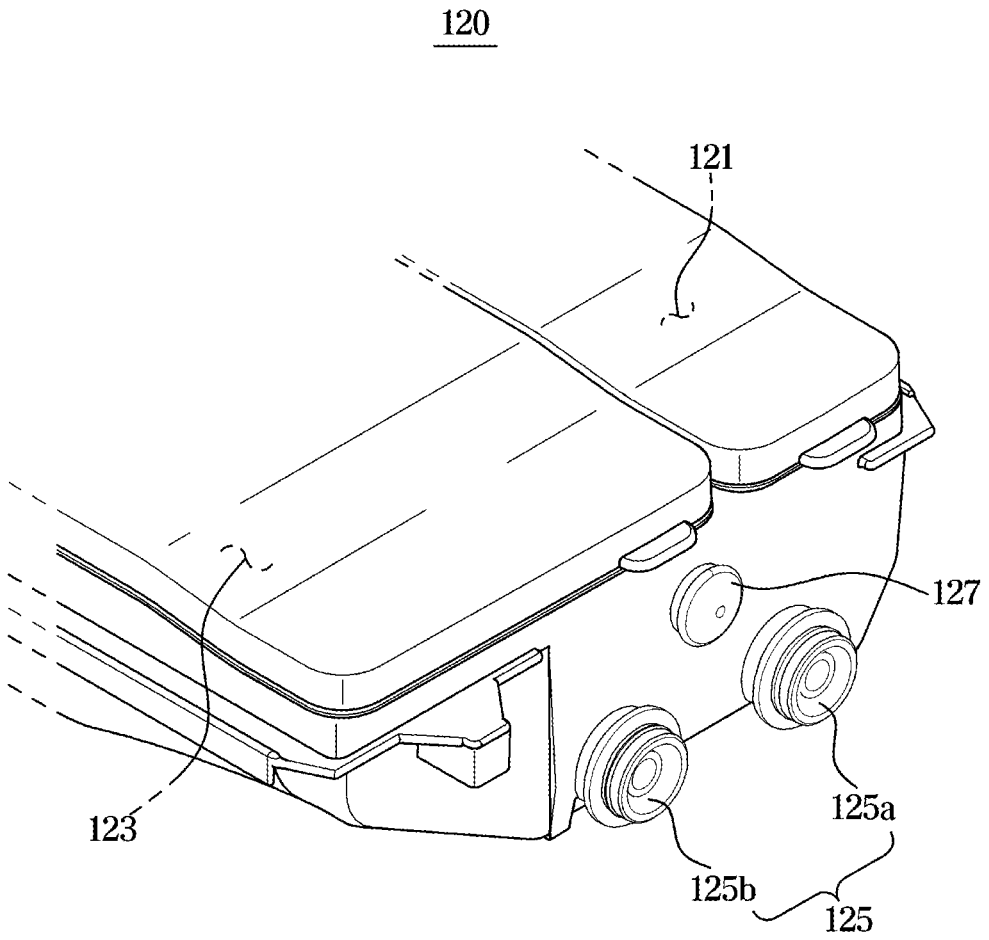
FIG. 8 is a view illustrating a state in which a detergent box is provided at a rear side thereof with a detergent discharge portion and an opening and closing member according to an embodiment of the disclosure.
Figure 9:
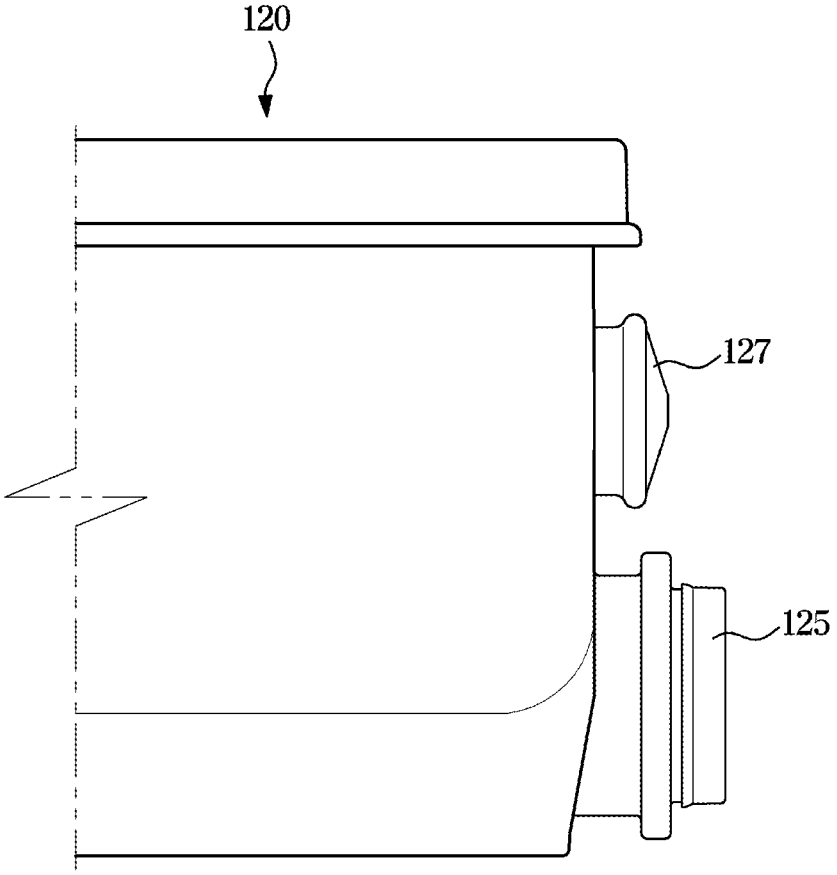
FIG. 9 is a view illustrating a state in which a detergent discharge portion protrudes further than an opening and closing member according to an embodiment of the disclosure.
Figure 10:
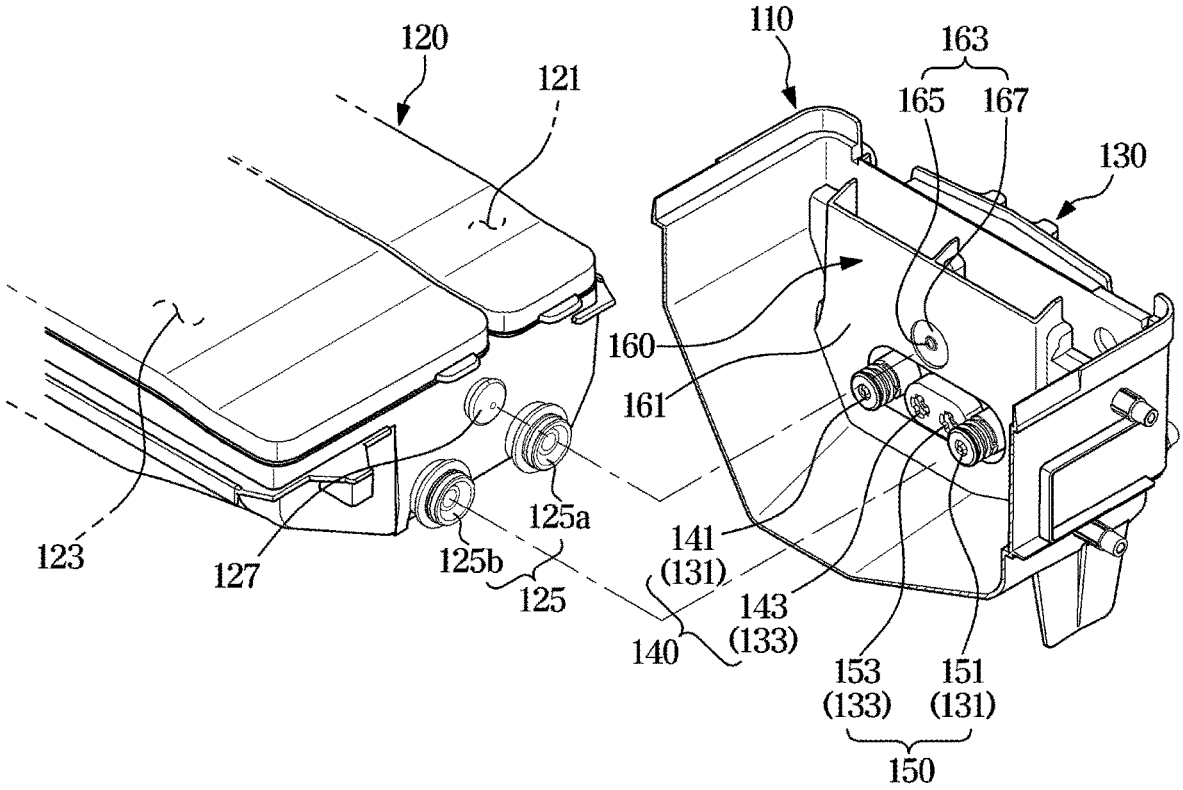
FIG. 10 is a view illustrating a process in which a detergent box is docked onto a detergent pump according to an embodiment of the disclosure.

FIG. 3 is an exploded view illustrating a part of a detergent supply apparatus according to an embodiment of the disclosure. FIG. 4 is a view illustrating a process in which a detergent pump of a detergent supply apparatus is fixed to a housing according to an embodiment of the disclosure. FIG. 5 is a side cross-sectional view illustrating a detergent supply apparatus according to an embodiment of the disclosure. FIG. 6 is a view illustrating a state in which an entry of a detergent discharge portion is completely submerged in a detergent according to an embodiment of the disclosure. FIG. 7 is a view illustrating a state in which an end tip of a second bent portion among bent portions is immersed in a detergent according to an embodiment of the disclosure. FIG. 8 is a view illustrating a state in which a detergent box is provided at a rear side thereof with a detergent discharge portion and an opening and closing member according to an embodiment of the disclosure. FIG. 9 is a view illustrating a state in which a detergent discharge portion protrudes further than an opening and closing member according to an embodiment of the disclosure. FIG. 10 is a view illustrating a process in which a detergent box is docked onto a detergent pump according to an embodiment of the disclosure.

Referring to FIGS. 3 to 10, the detergent supply apparatus 100 may include a housing 110 provided to have an opening 111 on the upper side of the tub 20 of the washing machine, a detergent box 120 inserted into or withdrawn from the housing 110 through the opening 111, and a detergent pump 130 fixed to the housing 110 (see FIG. 1).

The housing 110 may include the opening 111 provided in the front portion of the housing 110 to allow the detergent box 120 to be inserted or withdrawn therethrough, an opening portion 112 that is open to allow the detergent pump 130 fixed to the housing 110 to be connected to the detergent box 120, an extending portion 113 extending from the opening portion 112 and allowing a part of the detergent pump 130 to be inserted and fixed thereto, a water supply portion 114 allowing a detergent discharged from the detergent box 120 to the housing 110 by the detergent pump 130 to be supplied to the tub 20 together with water, and a housing cover 115 covering an upper side of the housing 110 (see FIG. 1).

The detergent box 120 in which detergent is stored may be inserted into and withdrawn from the housing 110 through the opening 111. Upon the detergent box 120 being inserted into the housing 110 through the opening 111, the detergent box 120 may be docked onto the detergent pump 130.

The detergent box 120 may be docked onto the detergent pump 130 through the opening portion 112 of the housing 110. Upon the detergent box 120 being docked onto the detergent pump 130 through the opening portion 112, the detergent from the inside the detergent box 120 and passing through the detergent pump 130 may be discharged into the housing 110 through the opening portion 112.

The extending portion 113 may extend from the opening portion 112 rearward of the opening portion 112. The detergent pump 130 fixed to the rear side of the housing 110 may be fixed while with a fixing portion 135, which will be described below, is inserted into the extending portion 113.

The water supply portion 114 may be provided on the bottom of the housing 110. The water supply portion 114 may be connected to the tub 20 through the supply pipe 17. Detergent discharged from the detergent box 120 to the bottom of the housing 110 by the detergent pump 130 may be mixed with water, and supplied to the tub 20 through the water supply portion 114 (see FIG. 1).

The housing cover 115 may cover the open upper side of the housing 110. The housing cover 115 may include a plurality of water supply holes 116 for supplying water into the housing 110. Water falling through the water supply holes 116 provided in a rear portion of the housing cover 115, among the plurality of water supply holes 116, may be supplied to an auxiliary tank 160, which will be described below, to fill the water storage portion 161.

The detergent box 120 may be inserted into or withdrawn from the housing 110 through the opening 111 of the housing 110. The detergent box 120 may store a main detergent (a powder detergent or a liquid detergent), a preliminary detergent, fabric softener, and bleach. The detergent box 120 may include a first detergent box 121 in which the main detergent is stored, and a second detergent box 123 in which the preliminary detergent, fabric softener, and bleach are stored. For the sake of convenience of description, the main detergent (a powder detergent or a liquid detergent), the preliminary detergent, the fabric softener, and the bleach may each be referred to as detergent. The first detergent box 121 may include a first inlet 121*a* for injecting a detergent into the first detergent box 121 and a first cover 121*b* for opening and closing the first inlet 121*a*. The second detergent box 123 may include a second inlet 123*a* for injecting a detergent into the second detergent box 123 and a second cover 123*b* for opening and closing the second inlet 123*a*.

The detergent box 120 may include a detergent discharge portion 125 for discharging a detergent stored in the detergent box 120. The detergent discharge portion 125 may be docked onto the detergent pump 130. The detergent discharge portion 125 may be provided to protrude from the rear side of the detergent box 120 so as to be docked onto the detergent pump 130. The detergent box 120 may be docked onto the detergent pump 130 to discharge a detergent to the detergent pump 130 through the detergent discharge portion 125. The detergent discharge portion 125 may include a first detergent discharge portion 125*a* for discharging the detergent stored in the first detergent box 121 and a second detergent discharge portion 125*b* for discharging the detergent stored in the second detergent box 123.

The detergent box 120 may include a bent portion 126 bent to have an "L" shape and provided on the upper side of the detergent discharge portion 125. The bent portion 126 may be provided inside the detergent box 120. The bent portion 126 may include a first bent portion 126*a* provided to extend forward from the upper side of the detergent discharge portion 126, and a second bent portion 126*b* provided to extend vertically downward from the first bent portion 126*a*.

The detergent in the detergent box 120 may be discharged to the detergent pump 130 through the detergent discharge portion 125. The detergent pump 130 may, based on a difference in pressures at an entry of the detergent discharge portion 125, suction the detergent inside the detergent box 120 and discharge the suctioned detergent into the housing 110.

The bent portion 126 may reduce the amount of unused detergent inside the detergent box 120. That is, as shown in FIG. 6, when the entry of the detergent discharge portion 125 is completely submerged in the detergent, the detergent pump 130 may form a normal pressure difference so that a desired amount of detergent may be suctioned into the detergent pump 130 and the detergent suctioned into the detergent pump 130 may be discharged to the housing 110.

However, when a portion of the entry of the detergent discharge portion 125 is exposed to the air, the detergent pump 130 may not form a normal pressure difference, and thus a less amount of detergent than desired may be suctioned into the detergent pump 130. In this case, since the amount of detergent suctioned into the detergent pump 130 is small, the amount of detergent discharged to the housing 110 is also small. Accordingly, the detergent that remains in the detergent box 130 without being suctioned into the detergent pump 130 may become unused detergent that may not be used for washing. As the amount of unused detergent increases, the washing performance may be lowered.

In order to reduce the amount of unused detergent, the bent portion 126 may be provided on the upper side of the detergent discharge portion 125 as shown in FIG. 7. When the detergent inside the detergent box 120 is in an amount in which a part of the entry of the detergent discharge portion 125 is exposed to the air, the bent portion 126 may prevent the entry of the detergent discharge portion 125 from being exposed to the air. That is, when the end tip of the second bent portion 126*b* among the bent portions 126 is immersed in the detergent, the entry of the detergent discharge portion 125 may be prevented from being exposed to the air. As a result, the amount of unused detergent may be reduced by the length of the second bent portion 126*b*.

The detergent box 120 may include an opening and closing member 127 that opens and closes a drain hole 165 of the auxiliary tank 160 to be described below. The opening and closing member 127 may be provided to protrude from the rear side of the detergent box 120. The opening and closing member 127 may close the drain hole 165 upon the detergent box 120 being inserted into the housing 110 and docked onto the detergent pump 130. The opening and closing member 127 may open the drain hole 165 upon the detergent box 120 being undocked from the detergent pump 130. Details thereof will be described below.

The detergent pump 130 may be fixed to the rear side of the housing 110. The detergent pump 130 may include: a fixing portion 135 including a suction portion 131 configured to suction a detergent from the detergent box 120 upon the detergent pump 130 being docked onto the detergent pump, and a discharge portion 133 configured to discharge the detergent, which is suctioned to the suction portion 131, to the housing 110; and a pumping portion 137 configured to perform pumping such that the detergent is suctioned into the suction portion 131 and then discharged to the discharge portion 133. The pumping portion 137 may be formed inside a cylinder 139.

The detergent pump 130 may include a first detergent pump 140 suctioning a detergent from the first detergent box 121 and discharging the suctioned detergent into the housing 110, and a second detergent pump 150 suctioning a detergent from the second detergent box 123 and discharging the suctioned detergent to the housing 110.

The first detergent pump 140 may include: a first suction portion 141 configured to suction a detergent upon the first detergent discharge portion 125*a* of the first detergent box 121 being docked onto the first detergent pump 140; a first discharge portion 143 configured to discharge the detergent, which is suctioned into the first suction portion 141, to the housing 110; and a first pumping portion 145 configured to perform pumping such that the detergent in the first detergent box 121 is suctioned into the first suction portion 141 and then discharged into the housing 110 through the first discharge portion 143 (see FIG.

Figure 15:
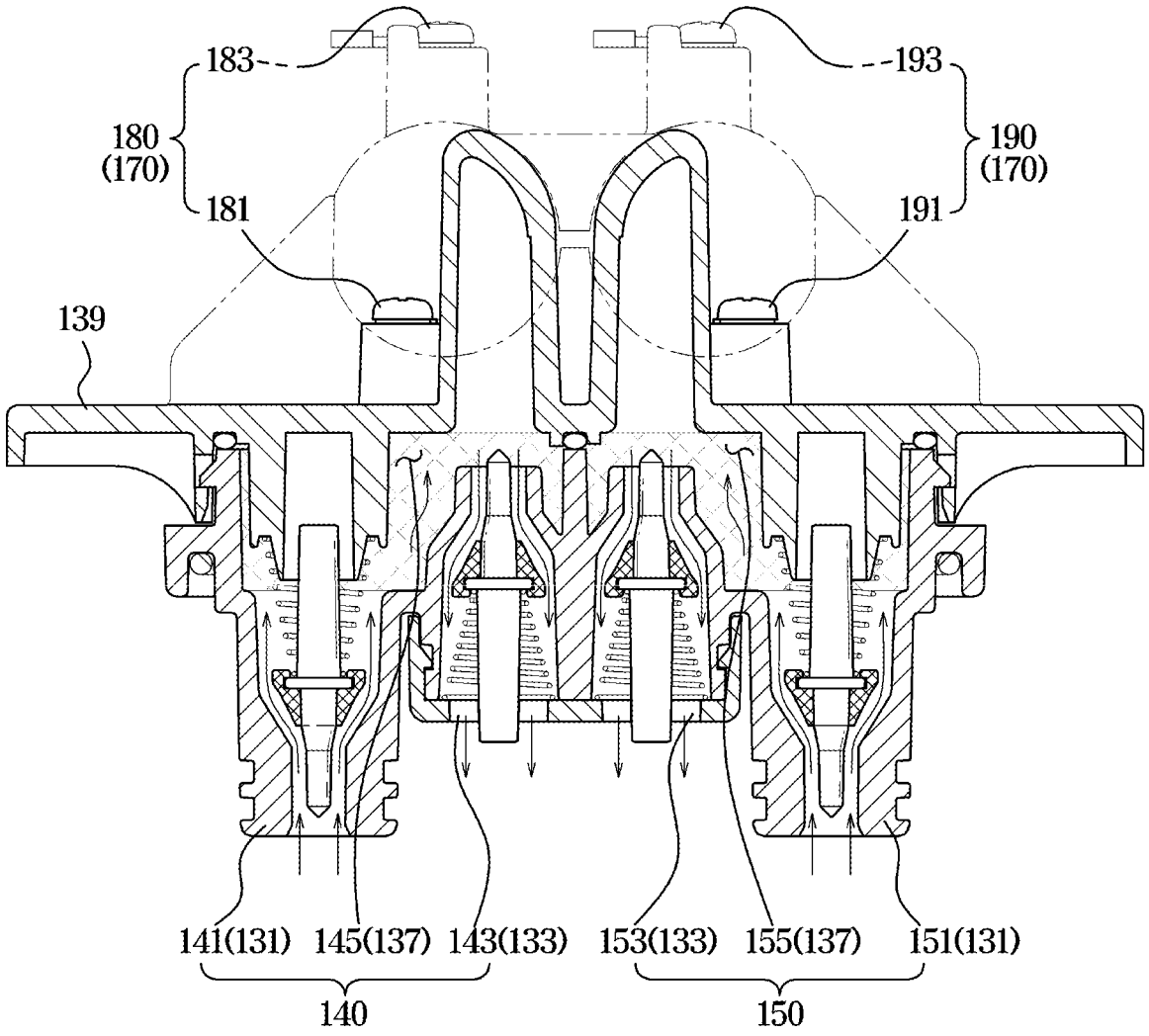
FIG. 15 is a view illustrating a process in which, upon a detergent box being docked onto a detergent pump, a detergent suctioned by a suction portion of the detergent pump is discharged via a pumping portion to a discharge portion according to an embodiment of the disclosure.

The second detergent pump 150 may include: a second suction portion 151 configured to suction a detergent upon the second detergent discharge portion 125*b* of the second detergent box 123 being docked onto the second detergent pump 150; a second discharge portion 153 configured to discharge the detergent, which is suctioned into the second suction portion 151, to the housing 110; and a second pumping portion 155 configured to perform pumping such that the detergent in the second detergent box 123 is suctioned into the second suction portion 151 and then discharged into the housing 110 through the second discharge portion 153 (see FIG. 15).

The detergent pump 130 may be provided with a detergent detecting unit 170 for detecting the remaining amount of detergent. The detergent detecting unit 170 may detect the remaining amount of detergent and display a notification that the detergent is insufficient on the display unit 16*b* of the washing machine when the amount of the detergent is insufficient. Upon a notification that the detergent is insufficient being displayed on the display unit 16*b*, the user may undock the detergent box 120 from the detergent pump 130 and withdraw the detergent box 120 from the housing 110 to replenish the detergent. Details of the detergent detecting unit 170 will be described below.

An auxiliary tank 160 may be provided inside the housing 110. The auxiliary tank 160 may be provided on a rear wall inside the housing 110. The auxiliary tank 160 may include a water storage portion 161 for storing water therein and a drain port 163 for draining the water stored in the water storage portion 161.

The water storage portion 161 may be filled with water falling through some of the plurality of water supply holes 116 provided in the housing cover 115. That is, when water is supplied by the water supply device 14, water falling through the water supply holes 116 provided in the rear portion of the housing cover 115 among the plurality of water supply holes 116 may be supplied to the water storage portion 161 and filled in the water storage portion 161.

The drain port 163 may be provided in a front lower portion of the water storage portion 161. The drain port 163 may include a drain hole 165 through which the water stored in the water storage portion 161 is drained, and a distribution groove 167 through which the water drained from the drain hole 165 is distributed and falls to the bottom of the housing 110.

The drain hole 165, upon the detergent box 120 being docked onto the detergent pump 130, may be closed by the opening and closing member 127 of the detergent box 120. While the drain hole 165 is closed by the opening and closing member 127, water may be supplied from the water supply device 14 to fill the water storage portion 161 (see FIG. 2).

The distribution groove 167 may be formed as a circular groove at a circumference of the drain hole 165. Water falling to the bottom of the housing 110 through the drain hole 165 may be distributed by the distribution groove 167 and fall.

The opening and closing member 127 provided together with the detergent discharge portion 125 on the rear side of the detergent box 120 and serving to open and close the drain hole 165 may protrude at a length shorter than a length of the detergent discharge portion 125. Since the opening and closing member 127 protrudes at a length shorter than a length of the detergent discharge portion 125, in a case in which the detergent box 120 is undocked from the detergent pump 130, the opening and closing member 127 may open the drain hole 165 earlier than it. That is, in a case in which the detergent box 120 is undocked from the detergent pump 130, the opening and closing member 127 opens the drain hole 165 before the detergent box 120 is completely undocked from the detergent pump 130 such that water stored in the water storage portion 161 may fall to the bottom of the housing 110 through the drain hole 165. This is to allow water to fall to the bottom of the housing 110 before a detergent remaining in the detergent pump 130 falls to the bottom of the housing 110, subsequent to the detergent box 120 being undocked from the detergent pump 130. Since a detergent remaining in the detergent pump 130 directly falling to the bottom of the housing 110 may harden on the bottom of the housing 110, the user may need clean the detergent personally. However, when the opening and closing member 127 opens the drain hole 165 before the detergent box 120 is completely undocked from the detergent pump 130, water falls to the bottom of the housing 110 through the drain hole 165, after which the detergent box 120 may be completely undocked from the detergent pump 130. That is, after the water first dropped on the bottom of the housing 110 forms a water film, the detergent box 120 is completely undocked from the detergent pump 130, and thus the detergent may fall onto the water film. When the detergent falls onto the water film, the detergent together with the water may be supplied to the tub 20 through the water supply portion 114 (see FIG. 2).

Figure 11:
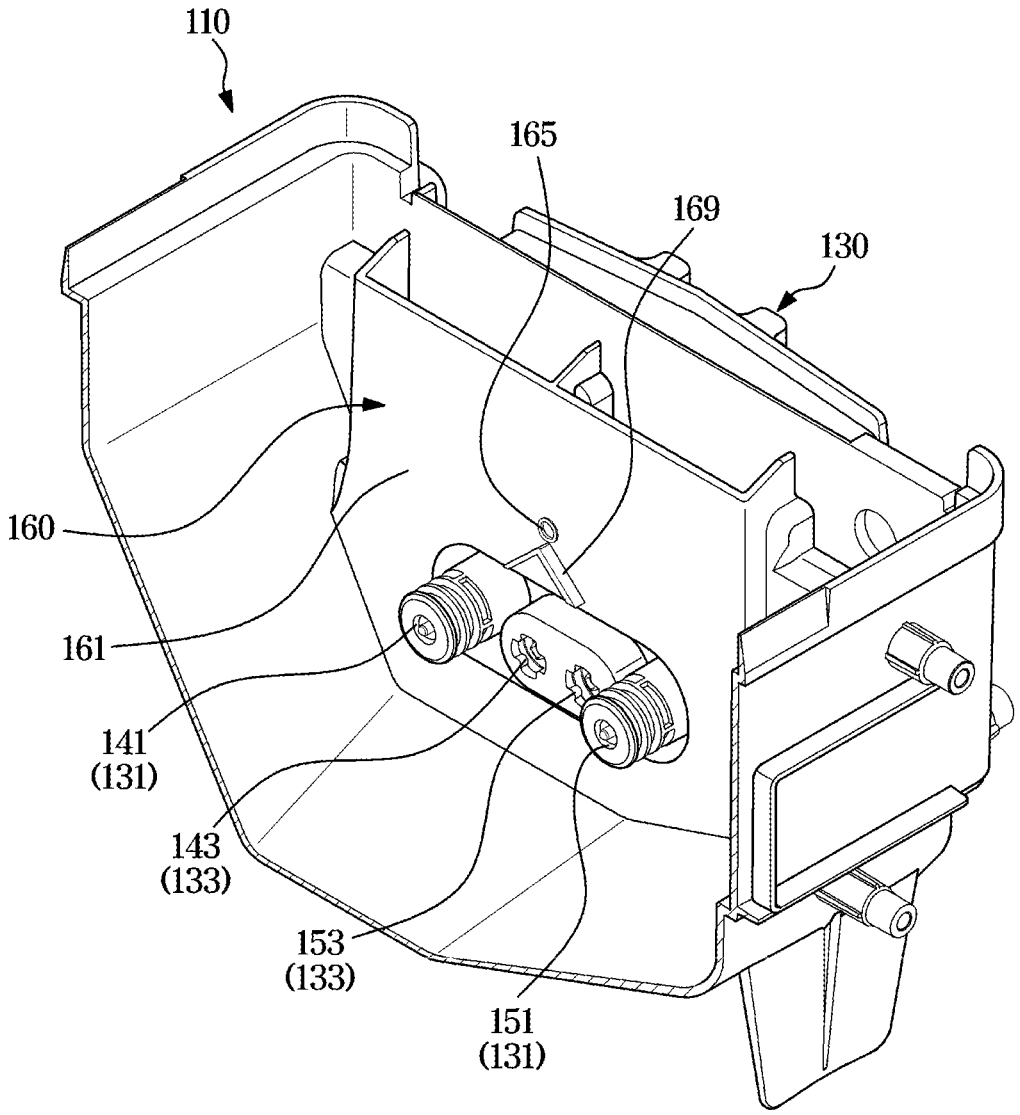
FIG. 11 is a view illustrating a configuration in which a drain port includes distribution ribs according to another embodiment of the disclosure.

FIG. 11 is a view illustrating a configuration in which a drain port includes distribution ribs according to another embodiment of the disclosure.

As shown in FIGS. 10-11, the drain port 163 may include a drain hole 165 through which the water stored in the water storage portion 161 is drained, and a distribution rib 169 that allows the water drained from the drain hole 165 to be distributed and fall to the bottom of the housing 110.

The configuration of the drain hole 165 and the configuration in which the drain hole 165 is opened and closed by the opening and closing member 127 of the detergent box 120 are the same as those shown in FIG. 8, and thus descriptions thereof will be omitted.

The distribution rib 169 may be provided on the rear side of the drain hole 165. The distribution rib 169 may be a V-shaped rib and may allow water falling from the drain hole 165 to be distributed and fall to the bottom of the housing 110. Although only a configuration in which the distribution rib 169 is provided at a lower side of the drain hole 165 is illustrated as the embodiment, the distribution rib 169 may be provided in other forms as long as it can allow the water falling from the drain hole 165 to be distributed and fall to the bottom of the housing 110.

Figure 12:
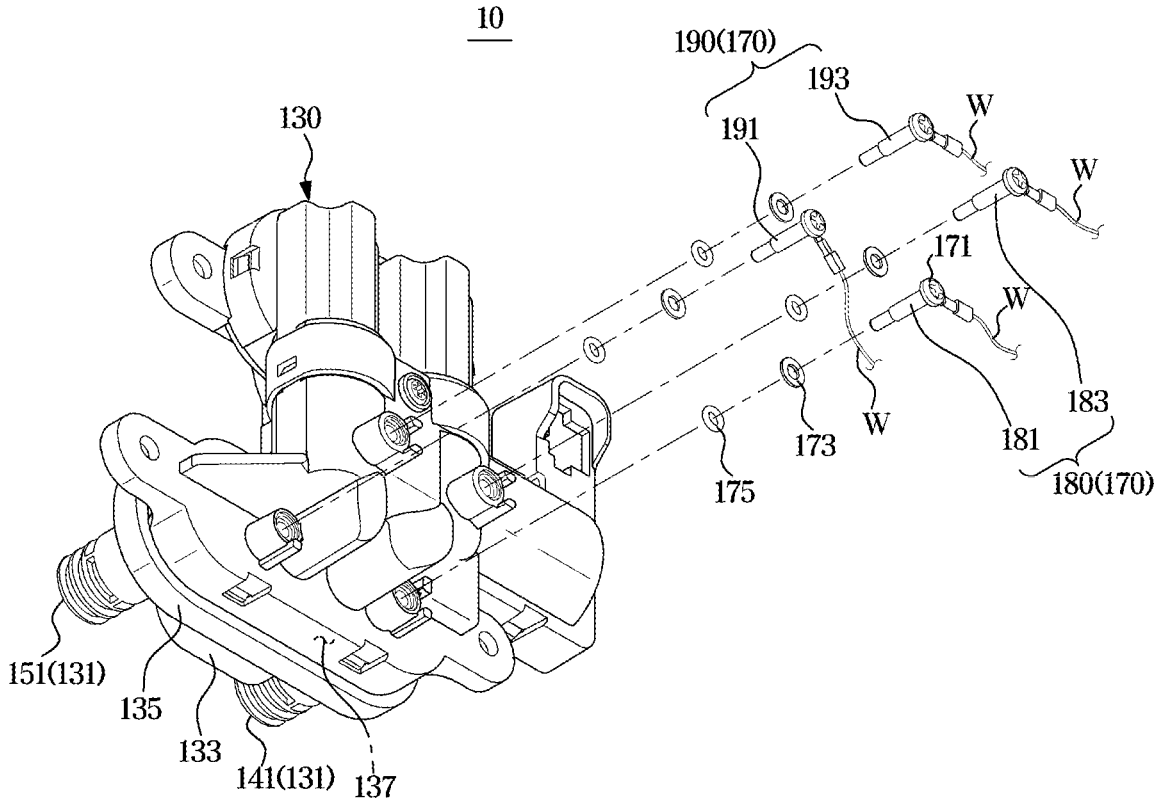
FIG. 12 is a view illustrating a state in which a detergent detecting unit is fixed to a detergent pump according to an embodiment of the disclosure.

FIG. 12 is a view illustrating a state in which a detergent detecting unit is fixed to a detergent pump according to an embodiment of the disclosure.

As shown in FIG. 12, the detergent pump 130 may be provided with a detergent detecting unit 170 for detecting the remaining amount of detergent. The detergent detecting unit 170 may be provided with a plurality of sensors. The detergent detecting unit 170 may be installed in the pumping portion 137 to detect the remaining amount of detergent. The detergent detecting unit 170 may be fixed to the outside of a cylinder 139 that forms the pumping portion 137.

Each of the detergent detecting units 170 including a plurality of sensors may be provided as a conductor so as to be directly connected to a wire W for transmitting a detected signal to a control unit (not shown). Since the detergent detecting unit 170 may be provided as a conductor and may be directly connected with the electric wire W, a separate connection part for connecting the electric wire W may not be required, thereby reducing the material cost. The detergent detecting unit 170 may include an electrode rod 171 fixed to the cylinder 139 while fixing the electric wire W, a washer 173 located on a lower side of the electrode rod 171, and a sealing 175 provided on a lower side of the washer 173 and sealing the pumping portion 137, which is an inside of the cylinder 139. An end tip located at a side opposite to the electrode rod 171 of the detergent detecting unit 170 may be located in the pumping portion 137, which is an inside of the cylinder 139, to detect the remaining amount of detergent.

The detergent detecting unit 170 may include a first detecting unit 180 installed as a pair of sensors in the first pumping portion 145 and a second detecting unit 190 installed as a pair of sensors in the second pumping portion 155.

The first detecting unit 180 may include a first sensor 181 and a second sensor 183 installed to have different heights based on the bottom of the housing 110. The first sensor 181 may be installed at a position lower than that of the second sensor 183. The remaining amount of detergent may be detected based on a difference in heights between the first sensor 181 and the second sensor 183. That is, when both the first sensor 181 and the second sensor 183 detect the detergent, the amount of detergent stored in the detergent box 120 may be sufficient for use. However, when only the first sensor 181 at a relatively low position detects the detergent and the second sensor 183 at a relatively high position does not detect the detergent, the insufficiency of the detergent may be delivered to the control unit, and may be displayed on the display unit 16*b* of the washing machine (see FIG. 1)

Since the first sensor 181 and the second sensor 183, which form the first detecting unit 180, are all installed in the first pumping portion 145, the diameter of the first suction portion 141 for suctioning a detergent from the detergent box 120 may be minimized. That is, when the first sensor 181 and the second sensor 183 for detecting the remaining amount of detergent are installed in the first suction portion 141, there is a restriction in minimizing the diameter of the first suction portion 141, but when both the first sensor 181 and the second sensor 183 are installed in the first pumping portion 145, the diameter of the first suction portion 141 may be minimized. Since the diameter of the first suction portion 141 is minimized, the amount of the detergent remaining in the first suction portion 141 upon the detergent box 120 being undocked from the detergent pump 130 may be reduced. Accordingly, the amount of the detergent falling from the detergent pump 130 to the bottom of the housing 110 upon the detergent box 120 being undocked from the detergent pump 130 may be reduced (see FIG. 14).

The second detecting unit 190 may include a third sensor 191 and a fourth sensor 193 installed to have different heights based on the bottom of the housing 110. The third sensor 191 may be installed at a position lower than that of the fourth sensor 193. The remaining amount of detergent may be detected based on a difference in heights between the third sensor 191 and the fourth sensor 193. That is, when both the third sensor 191 and the fourth sensor 193 detect the detergent, the amount of detergent stored in the detergent box 120 may be sufficient for use. However, when only the third sensor 191 at a relatively low position detects the detergent and the fourth sensor 193 at a relatively high position does not detect the detergent, the insufficiency of the detergent may be delivered to the control unit, and may be displayed on the display unit 16*b* of the washing machine (see FIG. 1)

Since the third sensor 191 and the fourth sensor 193, which form the second detecting unit 190, are all installed in the second pumping portion 155, the diameter of the second suction portion 151 for suctioning a detergent from the detergent box 120 may be minimized. That is, when the third sensor 191 and the fourth sensor 193 for detecting the remaining amount of detergent are installed in the second suction portion 151, there is a restriction in minimizing the diameter of the second suction portion 151, but when both the third sensor 191 and the fourth sensor 193 are installed in the second pumping portion 155, the diameter of the second suction portion 151 may be minimized. Since the diameter of the second suction portion 151 is minimized, the amount of the detergent remaining in the second suction portion 151 upon the detergent box 120 being undocked from the detergent pump 130 may be reduced. Accordingly, the amount of the detergent falling from the detergent pump 130 to the bottom of the housing 110 upon the detergent box 120 being undocked from the detergent pump 130 may be reduced (see FIG. 14).

The first sensor 181, installed at a lower position, of the first detecting unit 180 and the third sensor 191, installed at a lower position, of the second detecting unit 190 may be located at the same height. In addition, the second sensor 183, installed at a higher position, of the first detecting unit 180 and the fourth sensor 193, installed at a higher position, of the second detecting unit 190 may be located at the same height.

Figure 13:
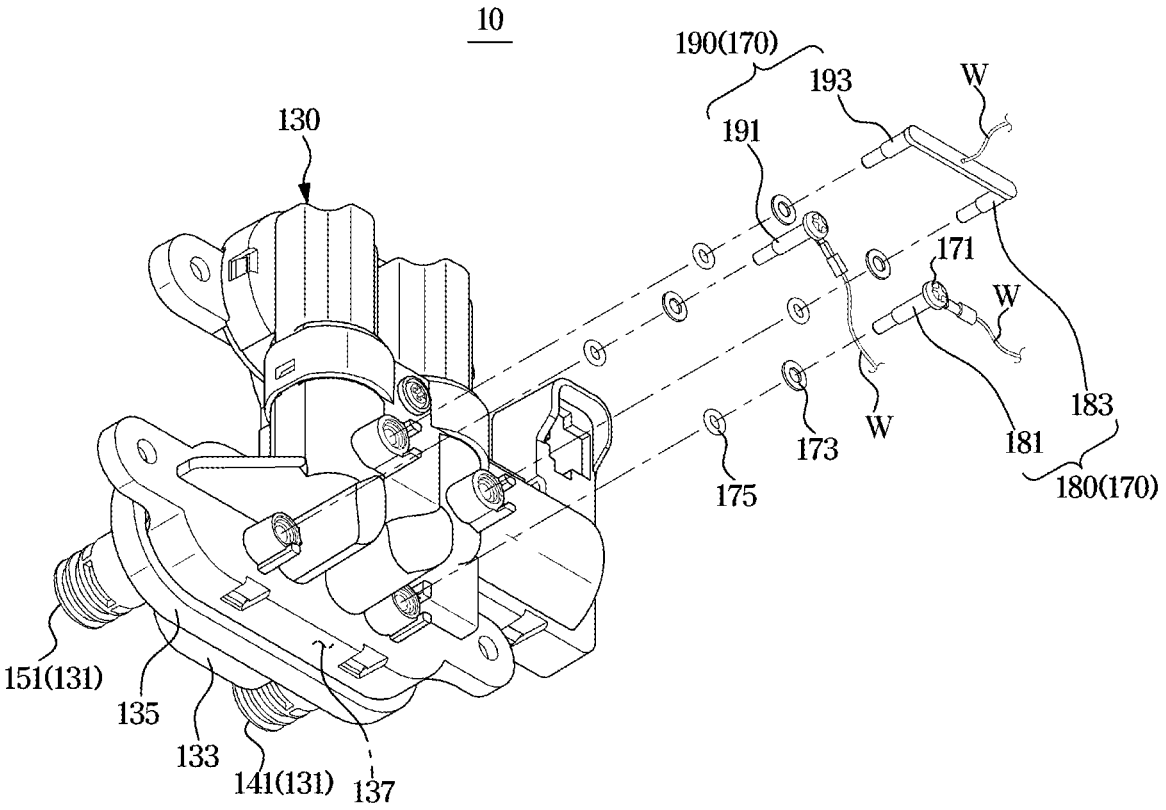
FIG. 13 is a view illustrating a state in which a detergent detecting unit is fixed to a detergent pump according to another embodiment of the disclosure.

FIG. 13 is a view illustrating a state in which a detergent detecting unit is fixed to a detergent pump according to another embodiment of the disclosure.

As shown in FIG. 13, when the distance between the first sensor 181 and the third sensor 191 located at the same height is shorter than the distance between the second sensor 183 and the fourth sensor 193, the first sensor 181 and the third sensor 191 located at a shorter distance therebetween may be integrally formed with each other. When the first sensor 181 and the third sensor 191 are integrally formed with each other, the number of wires W individually connected to the first sensor 181 and the third sensor 191 may be reduced to one, thereby reducing the material costs. Although the first sensor 181 and the third sensor 191 located at a shorter distance therebetween may be integrally formed with each other, the first sensor 181 and the third sensor 191 may separately informed and connected to each other by a conductor. Even in this case in which the first sensor 181 and the third sensor 191 are connected to each other by a conductor, the number of wires W may be reduced to one, thereby reducing the material cost.

In the drawing, the first sensor 181 and the third sensor 191 are illustrated as being located at a distance shorter than a distance between the second sensor 183 and the fourth sensor 193, and thus integrally formed with each other, but the disclosure is not limited thereto. That is, when the distance between the second sensor 183 and the fourth sensor 193 is shorter than the distance between the first sensor 181 and the third sensor 191, the second sensor 183 and the fourth sensor 193 located at a shorter distance may be integrally formed with each other. When the second sensor 183 and the fourth sensor 193 are integrally formed with each other, the number of wires W connected to the second sensor 183 and the fourth sensor 193 may be reduced to one, thereby reducing the material costs. Although the second sensor 183 and the fourth sensor 193 installed at a shorter distance therebetween may be integrally formed, the second sensor 183 and the fourth sensor 193 may be formed separately and connected to each other by a conductor. Even in this case in which the second sensor 183 and the fourth sensor 193 are connected to each other by a conductor, the number of wires W may be reduced to one, thereby reducing the material cost.

Next, with reference to FIGS. 14 to 21, an operation of docking or unlocking the detergent box onto or from the detergent pump will be described in detail.

Figure 14:
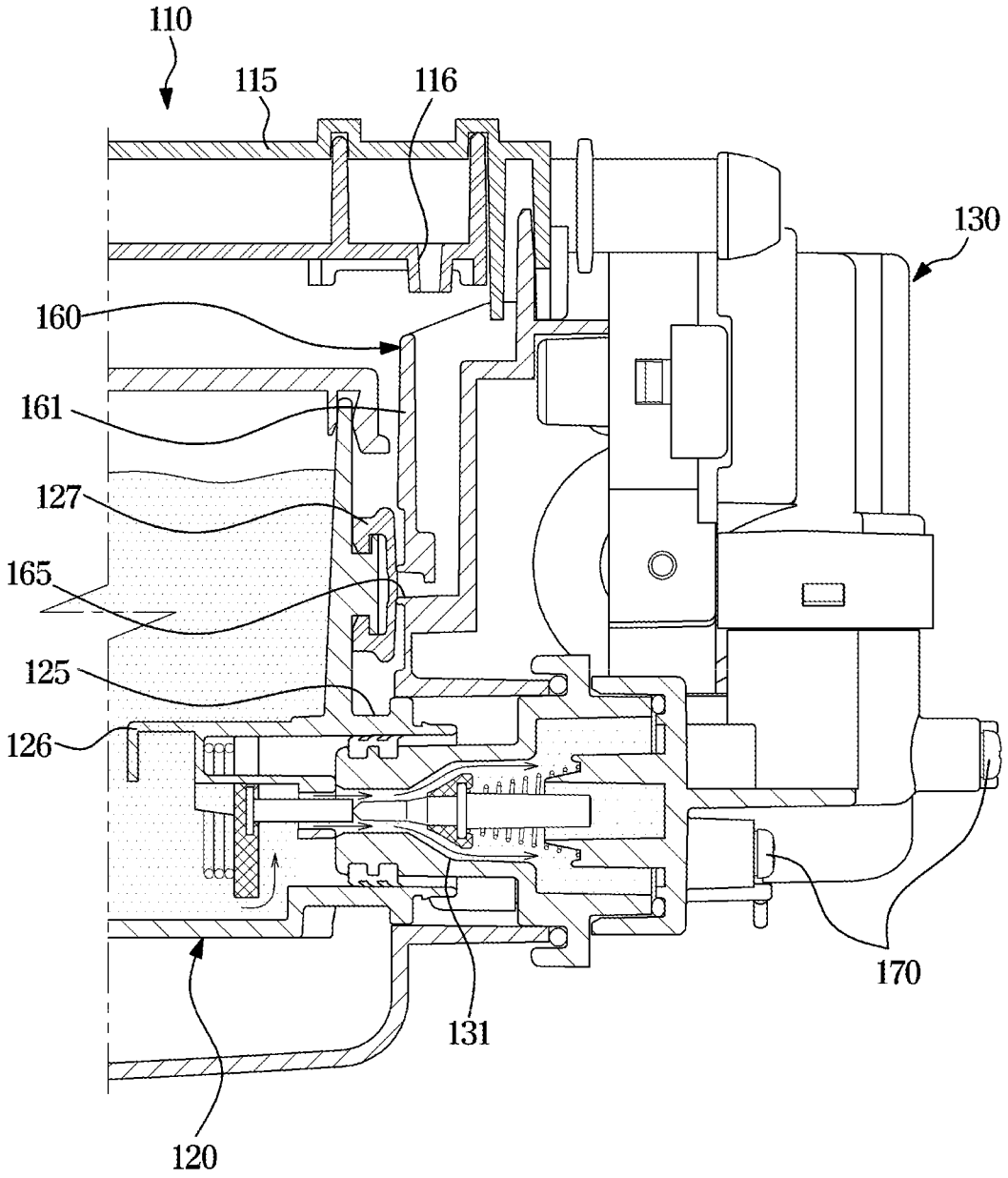
FIG. 14 is a view illustrating a state in which, upon a detergent box being docked onto a detergent pump, a detergent in a detergent box is into the detergent pump according to an embodiment of the disclosure.
Figure 16:
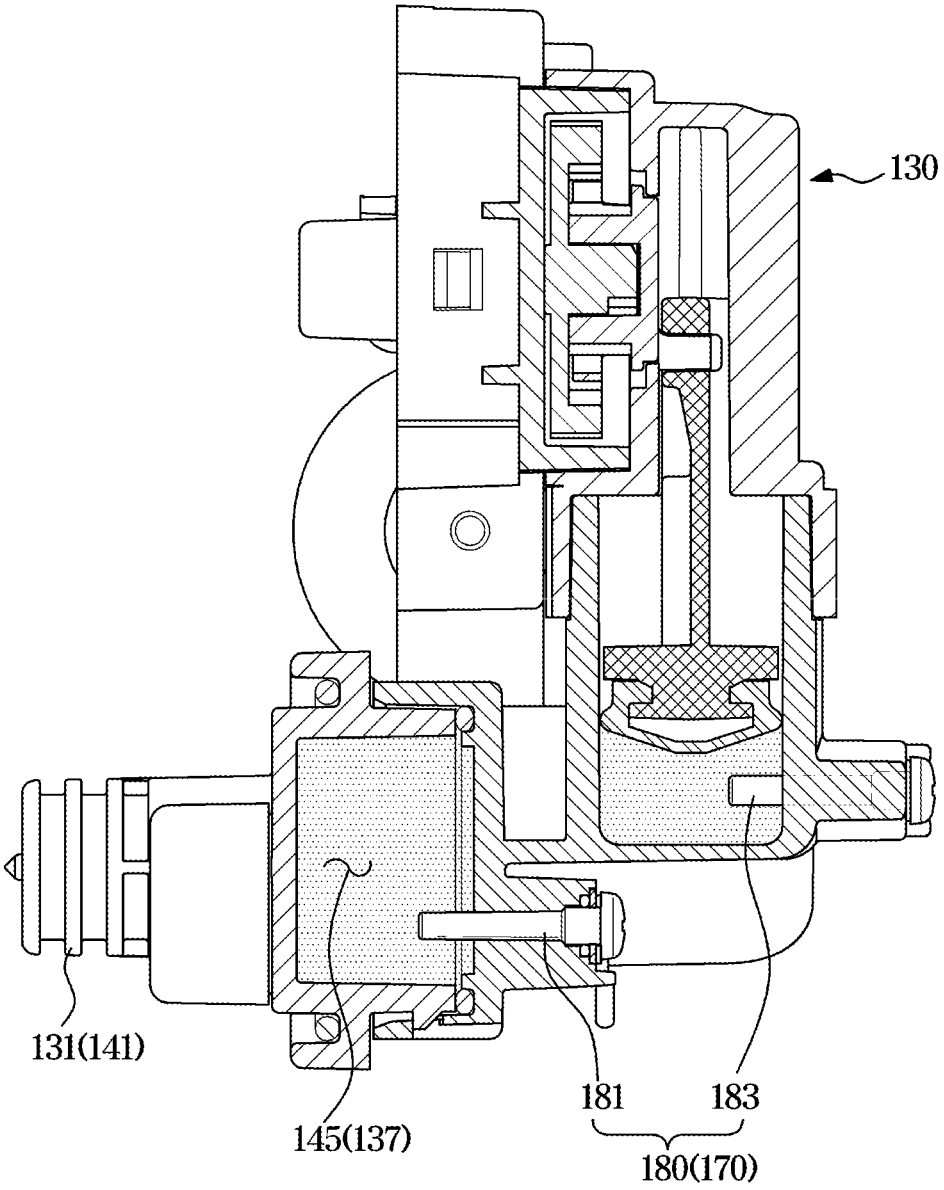
FIG. 16 is a view illustrating a state in which, upon a detergent box being docked onto a detergent pump, a detergent detecting unit detects the remaining amount of detergent according to an embodiment of the disclosure.
Figure 17:
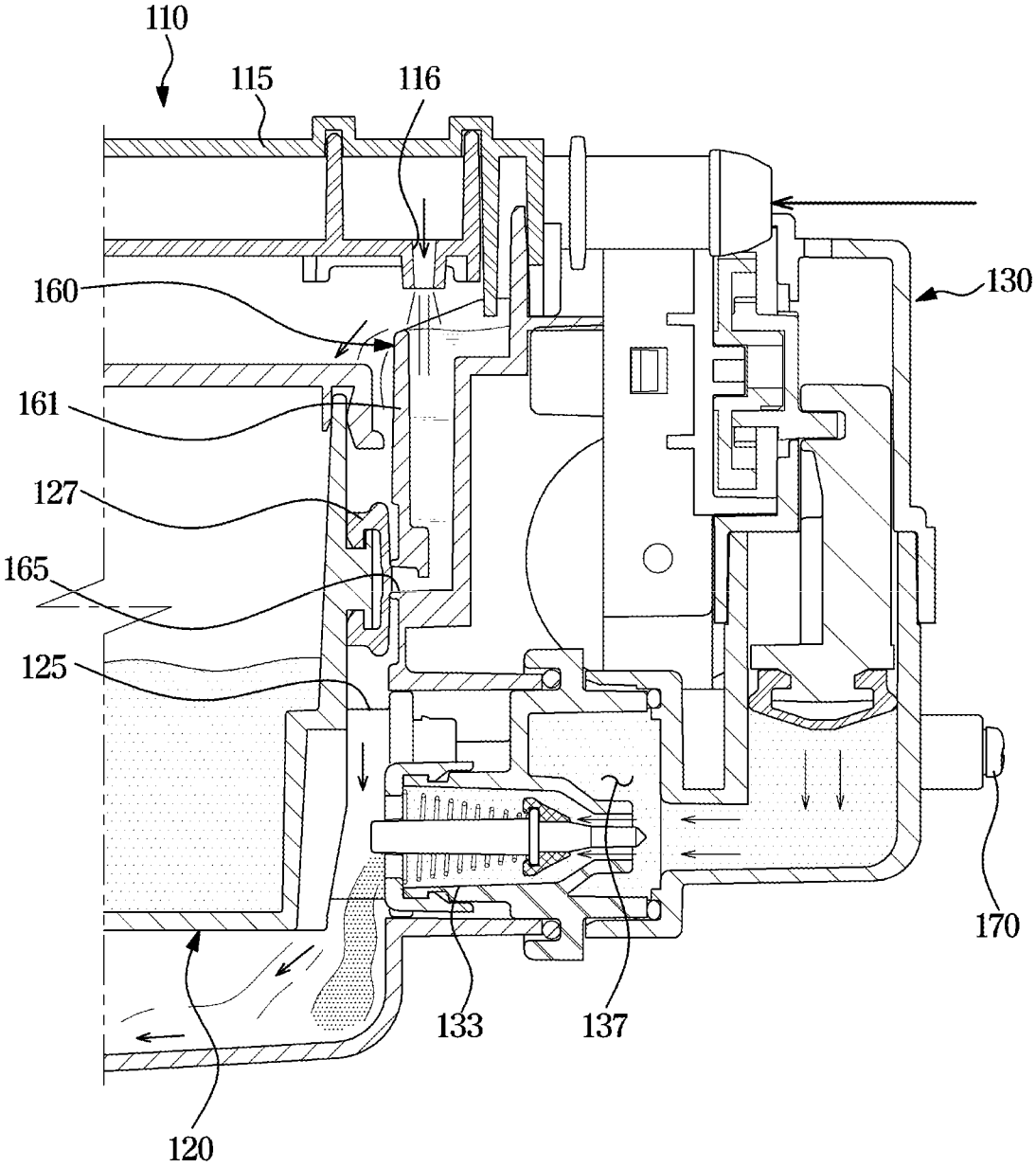
FIG. 17 is a view illustrating a state in which, upon a detergent box being docked onto a detergent pump, a detergent in the detergent box is discharged to the bottom of a housing by the detergent pump, and water supplied through a water supply hole is stored in a water storage portion according to an embodiment of the disclosure.
Figure 18:
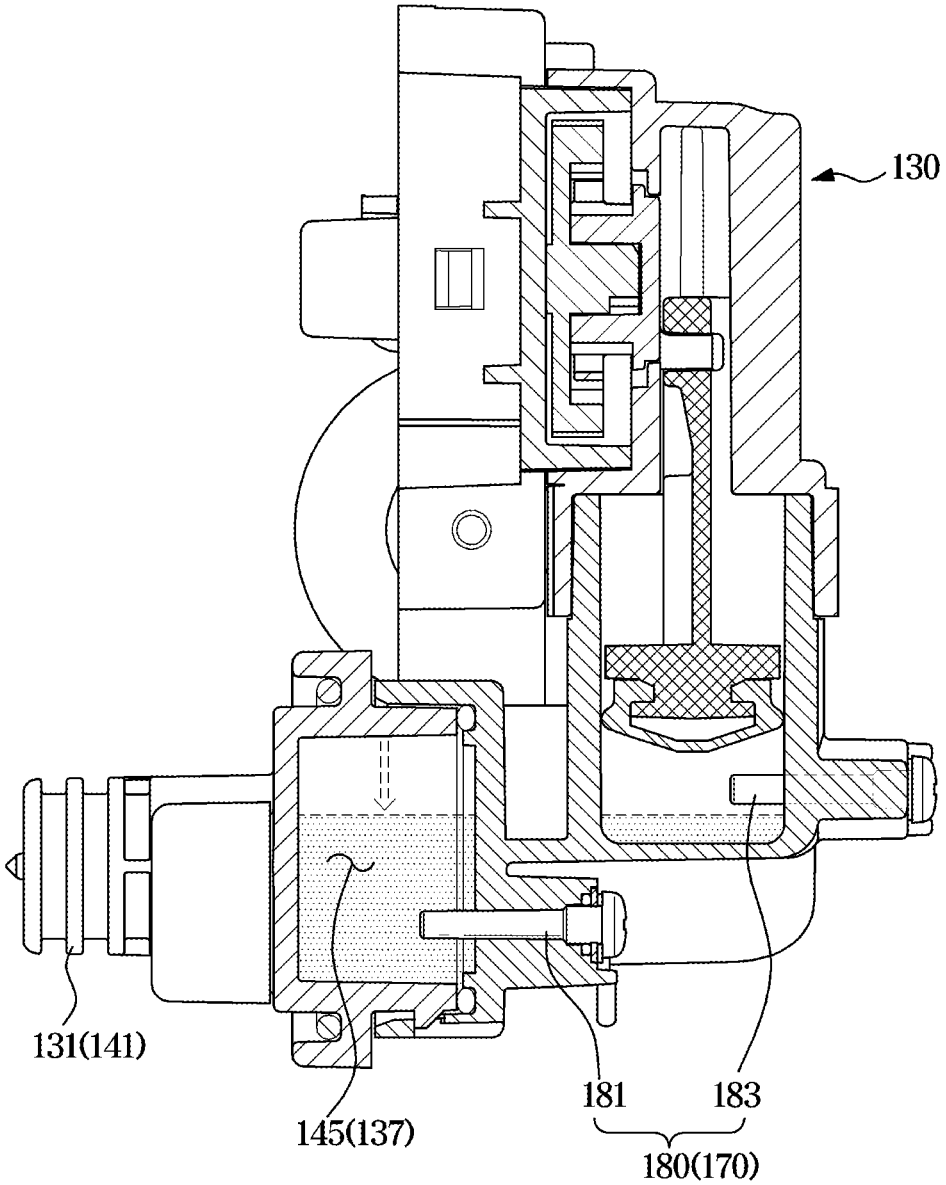
FIG. 18 is a view illustrating a state in which a detergent detecting unit detects that the remaining amount of detergent is insufficient according to an embodiment of the disclosure.
Figure 19:
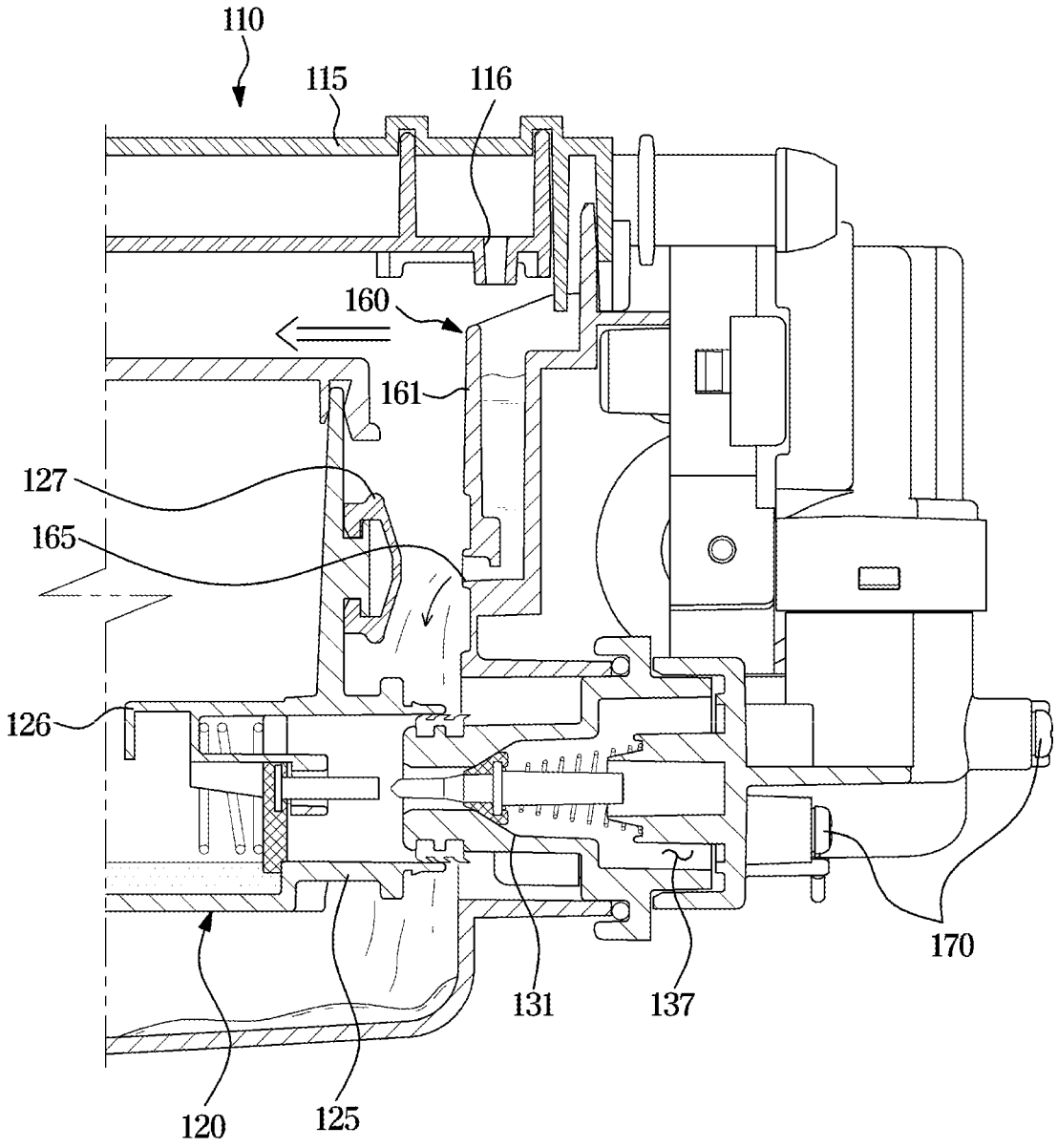
FIG. 19 is a view illustrating a state in which, upon a detergent box being undocked from a detergent pump to replenish the detergent box due to insufficiency of the remaining amount of detergent stored in the detergent box, an opening and closing member is opened for the water stored in an auxiliary tank is drained to the bottom of the housing according to an embodiment of the disclosure.
Figure 20:
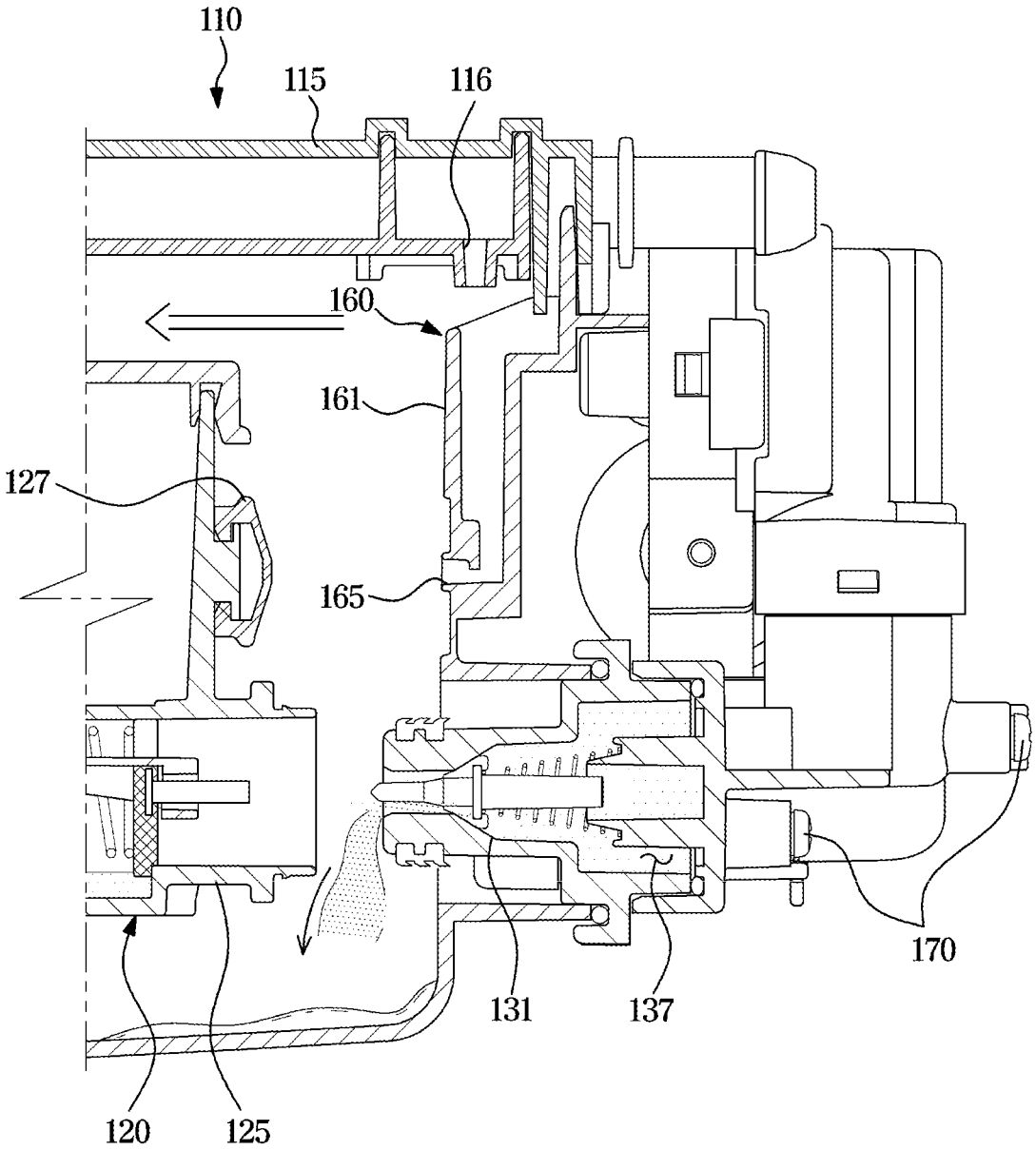
FIG. 20 is a view illustrating a state in which upon a detergent box being completely undocked from a detergent pump, the detergent remaining in a suction portion of the detergent pump falls onto a water film on the bottom of the housing according to an embodiment of the disclosure.
Figure 21:
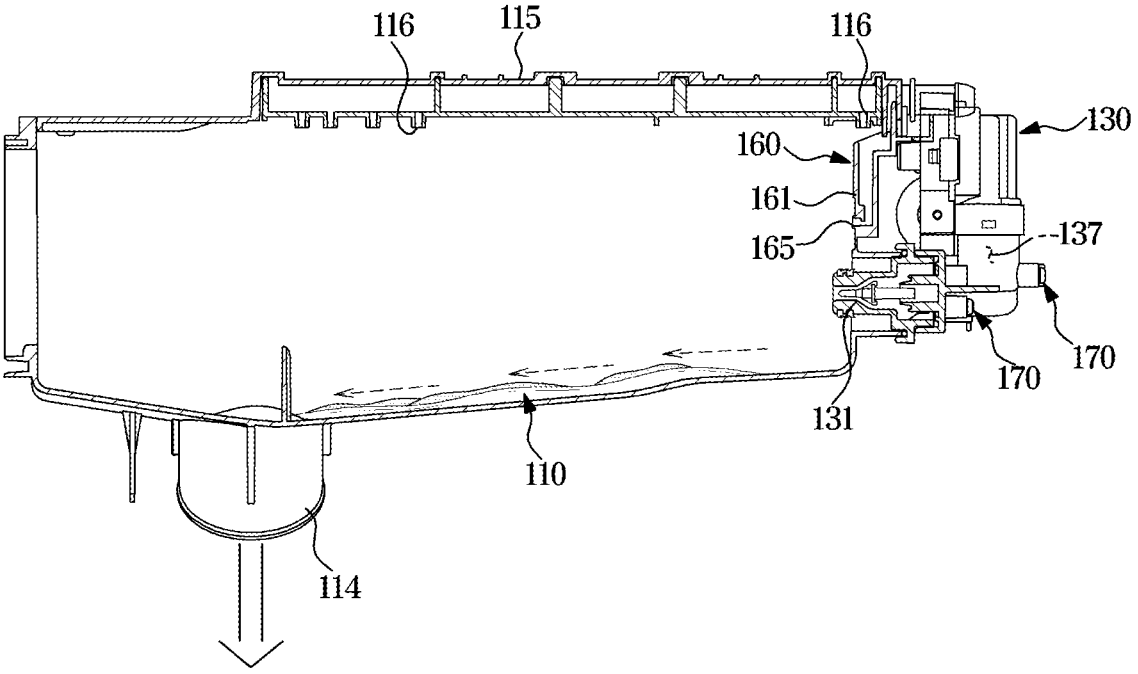
FIG. 21 is a view illustrating a state in which a detergent remaining in a suction portion of a detergent pump falls onto a water film on the bottom of a housing and is supplied to a water supply portion together with water.

FIG. 14 is a view illustrating a state in which, upon a detergent box being docked onto a detergent pump, a detergent in a detergent box is suctioned into the detergent pump according to an embodiment of the disclosure. FIG. 15 is a view illustrating a process in which, upon a detergent box being docked onto a detergent pump, a detergent suctioned by a suction portion of the detergent pump is discharged via a pumping portion to a discharge portion according to an embodiment of the disclosure. FIG. 16 is a view illustrating a state in which, upon a detergent box being docked onto a detergent pump, a detergent detecting unit detects the remaining amount of detergent according to an embodiment of the disclosure. FIG. 17 is a view illustrating a state in which, upon a detergent box being docked onto a detergent pump, a detergent in the detergent box is discharged to the bottom of a housing by a detergent pump, and water supplied through a water supply hole is stored in a water storage portion according to an embodiment of the disclosure. FIG. 18 is a view illustrating a state in which a detergent detecting unit detects that the remaining amount of detergent is insufficient according to an embodiment of the disclosure. FIG. 19 is a view illustrating a state in which, upon a detergent box being undocked from a detergent pump to replenish the detergent box due to insufficiency of the remaining amount of detergent stored in the detergent box, an opening and closing member is opened for the water stored in an auxiliary tank is drained to the bottom of the housing according to an embodiment of the disclosure. FIG. 20 is a view illustrating a state in which upon a detergent box being completely undocked from a detergent pump, the detergent remaining in a suction portion of the detergent pump falls onto a water film on the bottom of the housing according to an embodiment of the disclosure. FIG. 21 is a view illustrating a state in which a detergent remaining in a suction portion of a detergent pump falls onto a water film on the bottom of a housing and is supplied to a water supply portion together with water.

For the sake of convenience of description, the following description will be made in relation that the detergent discharge portion 125 of the detergent box 120 shown in FIGS. 14 to 21 is the first detergent discharge portion 125*a*, and the suction portion 131 of the detergent pump 130 is the first suction portion 141.

As shown in FIG. 14, when the detergent box 120 is inserted into the housing 110 and the first detergent discharge portion 125*a* of the detergent box 120 is docked onto the first suction portion 141 of the detergent pump 130, the detergent in the detergent box 120 may be suctioned into the first suction portion 141 through the first detergent discharge portion 125*a* by a pumping of the detergent pump 130.

As shown in FIG. 15, the detergent suctioned into the first suction portion 141 through the first detergent discharge portion 125*a* may be discharged to the first discharge portion 143 via the first pumping portion 145. The detergent suctioned into the second suction portion 151 through the second detergent discharge portion 125*b* may be discharged to the second discharge portion 153 through the second pumping portion 155. In this case, as shown in FIG. 16, both the first sensor 181 and the second sensor 183 of the detergent detecting unit 170 are immersed in the detergent, and thus the control unit may receive a signal indicating that the amount of the detergent is sufficient from the detergent detecting unit 170.

As shown in FIG. 17, when the detergent box 120 is docked onto the detergent pump 130 and the detergent stored in the detergent box 120 is discharged to the bottom of the housing 110 by the detergent pump 130, water supplied from the water supply device 14 may be supplied to the water storage portion 161 of the auxiliary tank 160 through the water supply holes 116. In this case, since the drain hole 165 of the auxiliary tank 160 is in a state closed by the opening and closing member 127 of the detergent box 120, water supplied through the water supply holes 116 may fill the water storage portion 161.

As shown in FIG. 18, when only the first sensor 181 is immersed in the detergent as the remaining amount of detergent decreases, the detergent detecting unit 170 may transmit, to the control unit, a signal indicating that the amount of the detergent is insufficient, and the signal may be displayed on the display unit 16*b* of the washing machine (see FIG. 1).

As shown in FIG. 19, when the amount of detergent is insufficient, the detergent box 120 may be withdrawn from the housing 110 to replenish the detergent in the detergent box 120. In a case in which the detergent box 120 is withdrawn from the housing 110, the opening and closing member 127 may open the drain hole 165 of the auxiliary tank 160 before the first detergent discharge portion 125*a* of the detergent box 120 is completely undocked from the first suction portion 141 of the detergent pump 130. Upon the drain hole 165 being opened, water stored in the water storage portion 161 may fall to the bottom of the housing 110. The water falling to the bottom of the housing 110 may form a water film.

As shown in FIG. 20, when the detergent box 120 is further withdrawn from the housing 110 and thus the first detergent discharge portion 125*a* of the detergent box 120 is completely unlocked from the first suction portion 141 of the detergent pump 130, the detergent remaining in the first suction portion 141 may fall onto the water film on the bottom of the housing 110. Since the detergent remaining in the first suction portion 141 does not directly fall to the bottom of the housing 110 but falls onto the water film, the detergent may be mixed with water and thus prevented from being hardened.

As shown in FIG. 21, the detergent that has fallen onto the water film of the bottom of the housing 110 may be supplied to the tub 20 together with water through the water supply portion 114 (see FIG. 1).

A specific shape and a specific direction of a detergent supply apparatus and a washing machine having the same have been described above with reference to the accompanying drawings, but the present disclosure may be variously modified and changed by those skilled in the art, and the modifications and changes should be interpreted as being included in the scope of the present disclosure.

What is claimed is:

1. A washing machine comprising:

a cabinet;

a tub inside the cabinet; and a detergent supply apparatus configured to supply detergent to the tub, the detergent supply apparatus including:

a housing, a detergent pump fixed to the housing, a detergent box configured to be inserted into the housing and thereby be docked to the detergent pump so that detergent in the detergent box is suctionable by the detergent pump and then dischargeable by the detergent pump into the housing, and configured to be withdrawn from the housing and thereby be undocked from the detergent pump, and an auxiliary tank, fixed in the housing, configured to store water and to, when the detergent box is being withdrawn from the housing, drain water stored in the auxiliary tank to a bottom of the housing so that detergent falling from the detergent pump falls into the water on the bottom of the housing.

2. The washing machine of claim 1, wherein the housing has an opening in a front portion of the housing through which the detergent box is insertable to be inserted into the housing and through which the detergent box is withdrawable to be withdrawn from the housing, and the auxiliary tank is on a rear wall inside the housing.

3. The washing machine of claim 1, wherein the auxiliary tank includes:

a water storage portion in which the stored water is stored, a drain port that includes a drain hole through which the water stored in the water storage portion is drained, and a circular distribution groove around the drain hole that distributes the water drained from the drain hole to the bottom of the housing.

4. The washing machine of claim 3, further comprising:

a housing cover covering an upper side of the housing and including a plurality of water supply holes through which water is suppliable to the housing so that water supplied through some of the plurality of water supply holes falls into and is stored in the water storage portion.

5. The washing machine of claim 3, wherein the detergent pump includes:

a fixing portion including a suction portion and a discharge portion, and a pumping portion configured to perform pumping so that detergent in the detergent box is suctioned into the suction portion, then discharged by the discharge portion into the housing.

6. The washing machine of claim 1, wherein the auxiliary tank includes:

a water storage portion in which the stored water is stored, a drain port that includes a drain hole through which the water stored in the water storage portion is drained, and a distribution rib at a lower side of the drain hole that distributes the water drained from the drain hole to the bottom of the housing.

7. The washing machine of claim 5, wherein the detergent box includes:

a detergent discharge portion configured to be docked to the suction portion to dock the detergent box to the detergent pump, and to be undocked from the suction portion to undock the detergent box from the detergent pump, and an opening and closing member configured to, upon the detergent discharge portion being docked to the suction portion, close the drain hole, and upon the detergent discharge portion being undocked from the suction portion, open the drain hole.

8. The washing machine of claim 7, wherein the detergent discharge portion and the opening and closing member each protrude rearward from a rear surface of the detergent box with the detergent discharge portion protruding further from the rear surface of the detergent box than the opening and closing member.

9. The washing machine of claim 8, wherein the detergent box is configured so that when the detergent box is being undocked from the suction portion, the opening and closing member opens the drain hole before the detergent discharge portion is completely undocked from the suction portion.

10. The washing machine of claim 9, wherein the detergent box is configured so that before the detergent discharge portion is completely undocked from the suction portion, the water stored in the water storage portion is drained to the bottom of the housing through the drain hole.

11. The washing machine of claim 7, wherein the housing includes:

an opening portion that is open to allow a part of the fixing portion to pass therethrough, an extending portion extending from the opening portion, into which a remaining part of the fixing portion is insertable to be fixed to the extending portion, and a water supply portion allowing detergent discharged from the discharge portion into the housing and through the opening portion to be supplied to the tub together with water.

12. The washing machine of claim 5, wherein the detergent box includes a first detergent box configured to hold a main detergent, and a second detergent box configured to hold a preliminary detergent, the detergent pump being configured to individually suction and discharge to the housing the main detergent and the preliminary detergent individually.

13. The washing machine of claim 12, wherein the detergent pump includes a first detergent pump configured to suction the main detergent from the first detergent box and discharge the main detergent to the housing, and a second detergent pump configured to suction the preliminary detergent from the second detergent box and discharge the preliminary detergent to the housing.

14. The washing machine of claim 13, further comprising:

a detergent detecting unit to detect detergent remaining in the detergent pump, the detergent detecting unit including a first detecting unit including a first sensor and a second sensor in the first detergent pump and a second detecting unit including a third sensor and a fourth sensor in the second detergent pump.

15. The washing machine of claim 14, wherein the first sensor and the second sensor have different heights from the bottom of the housing, and the third sensor and the fourth sensor have different heights from the bottom of the housing.

16. The washing machine of claim 1, wherein the auxiliary tank is positioned in the housing so as to be further rearward in the housing with respect to the detergent box when the detergent box is docked to the detergent pump.

* * * * *